US011711649B2

(12) United States Patent
Chen et al.

(10) Patent No.: US 11,711,649 B2
(45) Date of Patent: Jul. 25, 2023

(54) METHOD FOR AUDIO SIGNAL NOISE CANCELLATION, APPARATUS FOR AUDIO SIGNAL PROCESSING, AND ELECTRONIC DEVICE

(71) Applicant: Shenzhen Goodix Technology Co., Ltd., Guangdong (CN)

(72) Inventors: Jiachao Chen, Guangdong (CN); Chang Liu, Guangdong (CN); Xiaodong Yan, Guangdong (CN)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 59 days.

(21) Appl. No.: 17/567,102

(22) Filed: Dec. 31, 2021

(65) Prior Publication Data

US 2023/0007392 A1 Jan. 5, 2023

Related U.S. Application Data

(63) Continuation of application No. PCT/CN2021/103773, filed on Jun. 30, 2021.

(51) Int. Cl.
*H04R 3/00* (2006.01)
*G10K 11/16* (2006.01)
(Continued)

(52) U.S. Cl.
CPC ..... *H04R 3/02* (2013.01); *G10K 11/178* (2013.01)

(58) Field of Classification Search
CPC ... H04R 3/00; H04R 3/02; H04R 3/04; H04R 1/1083; H04R 2460/01; G10K 11/00;
(Continued)

(56) References Cited

U.S. PATENT DOCUMENTS 9,058,801 B2 * 6/2015 Po ..... G10K 11/17857
10,789,933 B1 9/2020 Li et al.
(Continued)

FOREIGN PATENT DOCUMENTS

CN 1249829 A 4/2000
CN 1685429 A 10/2005
(Continued)

OTHER PUBLICATIONS

Anonymous, Multiple buffering-Wikepedia, Jan. 21, 2012, 4 pgs. Retrived from the Internet: URL: https://en.wikepedia.org/w/index.php?title=Multiple_buffering&oldid=472463974.
(Continued)

*Primary Examiner* — Thang V Tran
(74) *Attorney, Agent, or Firm* — USCH Law, PC

(57) ABSTRACT

A method for audio signal noise cancellation is provided. In response to current noise cancellation coefficients being required to be updated to new noise cancellation coefficients, the digital signal processor calculates the new noise cancellation coefficients and writes the new noise cancellation coefficients into an idle storage module in the at least two storage modules, and the digital signal processor sends an update request for updating the noise cancellation coefficients to the active noise cancellation module. The update request carries position information configured to indicate a position of the storage module to which the new noise cancellation coefficients is written. The active noise cancellation module reads the new noise cancellation coefficients in the storage module indicated by the position information based on the position information carried in the update request, and performs noise cancellation processing according to the new noise cancellation coefficients after a current noise cancellation processing cycle ends.

20 Claims, 15 Drawing Sheets

(51) Int. Cl.
*H04R 3/02* (2006.01)
*G10K 11/178* (2006.01)

(58) Field of Classification Search
CPC .... G10K 11/16; G10K 11/175; G10K 11/178; G10K 11/17853; G10K 11/17854; G10K 11/17881; G10K 11/17885; G10K 11/17879; G10K 2210/3022; G10K 2210/3023; G10K 2210/3028; G10K 2210/3033; G10K 2210/3056; G06F 12/0284
See application file for complete search history.

(56) References Cited

U.S. PATENT DOCUMENTS

| | | | | |
|---|---|---|---|---|
| 10,950,213 | B1 * | 3/2021 | Lu | G10K 11/17881 |
| 11,189,261 | B1 * | 11/2021 | Lu | G10K 11/17881 |
| 2006/0176546 | A1 | 8/2006 | Wakui | |
| 2009/0245342 | A1 * | 10/2009 | Graffouliere | H04L 25/03038 375/232 |
| 2010/0272276 | A1 * | 10/2010 | Carreras | H04R 1/1008 381/71.8 |
| 2011/0222698 | A1 * | 9/2011 | Asao | G10K 11/17881 381/71.1 |
| 2013/0156214 | A1 | 6/2013 | Murthy et al. | |
| 2014/0072134 | A1 | 3/2014 | Po et al. | |
| 2014/0233750 | A1 | 8/2014 | Park et al. | |
| 2018/0220225 | A1 | 8/2018 | Murata et al. | |
| 2020/0135162 | A1 * | 4/2020 | Hein | B60W 40/06 |
| 2022/0230617 | A1 * | 7/2022 | Tani | G10K 11/17879 |

FOREIGN PATENT DOCUMENTS

| | | | |
|---|---|---|---|
| CN | 101179294 | A | 5/2008 |
| CN | 101222243 | A | 7/2008 |
| CN | 107945784 | A | 4/2018 |
| CN | 109246515 | A | 1/2019 |
| CN | 109756822 | A | 5/2019 |
| CN | 110599996 | A | 12/2019 |
| CN | 111627415 | A | 9/2020 |
| CN | 112634932 | A | 4/2021 |
| CN | 112669864 | A | 4/2021 |
| CN | 112954547 | A | 6/2021 |
| CN | 113035167 | A | 6/2021 |
| GB | 2522760 | A | 8/2015 |
| WO | 2010129241 | A1 | 11/2010 |
| WO | 2020205864 | A1 | 10/2020 |

OTHER PUBLICATIONS

Shenzhen Goodix Technology Co.,Ltd., Extended European Search Report, EP 21827526.1, dated Sep. 9, 2022, 11 pgs.

Shenzhen Goodix Technology Co., Ltd., CN First Office Action with English Translation, CN 202110737222.1, dated Aug. 10, 2021, 10 pgs.

Shenzhen Goodix Technology Co., Ltd., CN Notification to Grant Patent Right for Invention with English Translation, CN 202110737222.1, dated Aug. 24, 2021, 6 pgs.

* cited by examiner

METHOD FOR AUDIO SIGNAL NOISE CANCELLATION, APPARATUS FOR AUDIO SIGNAL PROCESSING, AND ELECTRONIC DEVICE

CROSS REFERENCE TO RELATED APPLICATIONS

The present disclosure is a continuation of PCT Patent Application No. PCT/CN2021/103773, filed on Jun. 30, 2021, which is incorporated by reference herein in its entirety.

TECHNICAL FIELD

The present disclosure relates to the field of audio signal processing technologies, in particular to a method for audio signal noise cancellation, an apparatus for audio signal processing, and an electronic device.

BACKGROUND

Active noise cancellation (ANC) has been widely used in electronic products such as wired headphones, true wireless stereo (TWS) headphones, even automotive sound systems, which brings consumers an increasingly extreme acoustic experience. A basic working principle of the active noise cancellation is that a noise cancellation microphone obtains noise of the external environment as a reference signal to input into a noise cancellation circuit, and the noise cancellation circuit produces a signal of equal frequency and amplitude and opposite phase to the reference signal to cancel the noise. Compared with analog ANC, digital ANC has the advantages of strong stability, good flexibility and higher yield. Therefore, it is future development direction to use digital chips for realizing ANC noise cancellation processing.

In an ANC system, i.e., an audio output device with ANC function, ambient noise characteristics often change. In order to keep the best noise cancellation effect of ANC at all times, the ANC system constantly adjusts filter coefficients of each filter in the system to realize adaptive ANC. A simple method to update coefficients is to turn the ANC off each time the coefficients are being updated, and then turn the ANC back on after all the coefficients are updated. If the update time is short, with respect to such an update method, it is difficult for the user to perceive that the noise cancellation is interrupted, which does not affect the user experience. However, when more coefficients are required to be updated or a system bus is busy, the update time may be longer, and restarting the ANC may affect the user experience. Another method is to dynamically update the coefficients without turning off the ANC, but the coefficients are easily mixed up before and after the update, thus causing the noise and affecting the user's auditory feeling.

SUMMARY

Some embodiments of the present disclosure are intended to provide a method for audio signal noise cancellation, an apparatus for audio signal processing, and an electronic device, which improve integrity of coefficient update when the coefficient update is performed without turning off active noise cancellation, avoid noise caused by the coefficient update, improve effect of the active noise cancellation, and improve user's auditory feeling.

Some embodiments of the present disclosure provide a method for audio signal noise cancellation, applied at an apparatus for audio signal processing, wherein the apparatus for audio signal processing includes a digital signal processor, an active noise cancellation module and at least two storage modules, and the method includes: in response to current noise cancellation coefficients being required to be updated to new noise cancellation coefficients, the digital signal processor calculating the new noise cancellation coefficients and writing the new noise cancellation coefficients into an storage module that is idle in the at least two storage modules, and the digital signal processor sending an update request for updating the noise cancellation coefficients to the active noise cancellation module, wherein the update request carries position information configured to indicate a position of the storage module to which the new noise cancellation coefficients is written; and the active noise cancellation module reading the new noise cancellation coefficients in the storage module indicated by the position information based on the position information carried in the update request, and performing noise cancellation processing according to the new noise cancellation coefficients after a current noise cancellation processing cycle ends.

Some embodiments of the present disclosure further provide an apparatus audio signal processing, comprising: a digital signal processor, an active noise cancellation module and at least two storage modules; wherein in response to current noise cancellation coefficients being required to be updated to new noise cancellation coefficients, the digital signal processor is configured to calculate the new noise cancellation coefficients, write the new noise cancellation coefficients into an storage module that is idle in the at least two storage modules, and send an update request for updating the noise cancellation coefficients to the active noise cancellation module, wherein the update request carries position information configured to indicate a position of the storage module to which the new noise cancellation coefficients is written; and the active noise cancellation module is configured to read the new noise cancellation coefficients in the storage module indicated by the position information based on the position information carried in the update request, and perform noise cancellation processing according to the new noise cancellation coefficients after a current noise cancellation processing cycle ends.

Some embodiments of the present disclosure further provide an electronic device, comprising: an apparatus for audio signal collection and the apparatus for audio signal processing according to the above embodiments, wherein the apparatus for audio signal processing is configured to perform noise cancellation processing on audio signals collected by the apparatus for audio signal collection.

In the embodiments of the present disclosure, in response to current noise cancellation coefficients being required to be updated to new noise cancellation coefficients without turning off the active noise cancellation module, the digital signal processor calculates the new noise cancellation coefficients and writes the new noise cancellation coefficients into an storage module that is idle in the at least two storage modules, and the digital signal processor sends an update request for updating the noise cancellation coefficients to the active noise cancellation module. The update request carries position information configured to indicate a position of the storage module to which the new noise cancellation coefficients is written. Then, the active noise cancellation module reads the new noise cancellation coefficients in the storage module indicated by the position information based on the position information carried in the update request, and performs noise cancellation processing according to the new noise cancellation coefficients after a current noise cancellation processing cycle ends. In the solution of the present disclosure, the active noise cancellation module does not immediately update the coefficients used in a process of the noise cancellation processing after receiving the update request, but selects the end of the current noise cancellation processing cycle as a timing for updating the old coefficients to new coefficients in the noise cancellation processing, so as to ensure that the noise cancellation processing may still be performed in the current noise cancellation processing cycle based on the noise cancellation coefficients before the update as a whole, and the noise cancellation processing may be performed in the subsequent noise cancellation processing cycle based on updated noise cancellation coefficients as a whole, thereby improving integrity of noise cancellation coefficient update, avoiding noise caused by the noise cancellation coefficient update, and improving user's auditory feeling.

BRIEF DESCRIPTION OF THE DRAWINGS

One or more embodiments are described as examples with reference to the corresponding figures in the accompanying drawings, and the examples do not constitute a limitation to the embodiments. Elements with the same reference numerals in the accompanying drawings represent similar elements. The figures in the accompanying drawings do not constitute a proportion limitation unless otherwise stated.

DETAILED DESCRIPTION

In order to make objectives, technical solutions and advantages of the present disclosure clearer, embodiments of the present disclosure will be described below in detail with reference to accompanying drawings and embodiments. It should be understood that, in various embodiments, many technical details are proposed for the reader to better understand the present disclosure. However, the technical solutions claimed in the present disclosure may be realized even without these technical details and various changes and modifications based on the following embodiments. The following embodiments are divided for convenience of description, and shall not constitute any limitation on specific implementations of the present disclosure. The embodiments may be referenced to each other and combined with each other without contradiction.

In a hardware system of complex active noise cancellation, with respect to one audio sampling data, an active noise cancellation module usually takes a noise cancellation processing cycle as a period in which the audio sampling data is input into the active noise cancellation module and the noise cancellation module performs all noise cancellation processing on the audio sampling data to finally output audio data after noise cancellation. The active noise cancellation module starts active noise cancellation processing of a next audio sampling data after the active noise cancellation processing performed on the audio sampling data is completed and corresponding audio data after noise cancellation is output.

The active noise cancellation module mainly includes various filters. In one noise cancellation processing cycle, the active noise cancellation module reads, along with a processing phase where the audio sampling data is, coefficients (collectively referred to as "noise cancellation coefficients") of filters required for the processing phase from a storage module to complete processing operations in this processing phase. Because a running environment of the active noise cancellation module is changeable, it is necessary to update the noise cancellation coefficient of the active noise cancellation module so as to achieve the best noise cancellation effect.

Figure 1:
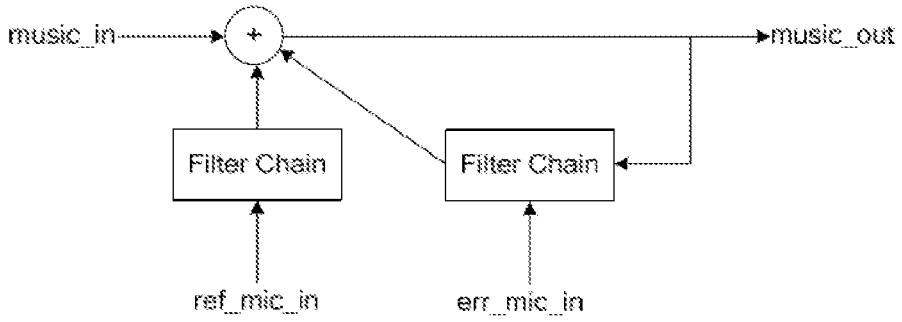
FIG. 1 is a specific structure diagram of a basic data path of typical digital ANC in the existing technology.

The active noise cancellation (ANC) module is a noise cancellation module commonly used for noise cancellation of audio data. FIG. 1 is a basic data path of a typical digital ANC module. Data (ref_mic_in) of a reference microphone in the data path is processed through a filter chain and is added to input audio data (music_in) to form a feedforward path. Data (err_mic_in) of an error microphone and output audio data (music_out) are processed through another filter chain and are added to music_in to form a feedback path.

Figure 2:
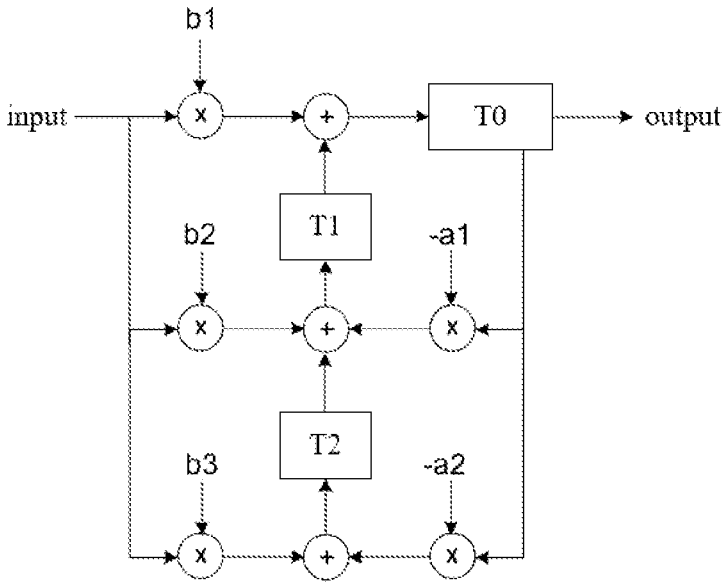
FIG. 2 is a schematic structural diagram of a transposed direct type II biquad filter in the existing technology.

In the filter chains shown in FIG. 1, a finite impulse response (FIR) filter and an infinite impulse response (IIR) filter are widely used. A biquad filter is one of the most commonly used IIR filters, which has variously different structures. FIG. 2 is a structure diagram of a transposed direct type II biquad filter in the existing technology, which is suitable for hardware implementation. A higher-level filter may be constructed by using the biquad filter as a basic unit to meet complex requirements on audio control.

In an ANC system, i.e., an audio output device with ANC function, it is necessary to adjust the filter coefficients in the ANC module continuously through software algorithm to realize adaptive ANC in order to keep the best noise cancellation effect at all times because ambient noise characteristics often change. Due to a recursive property of the IIR filter in the filter chain, dynamic update of filter coefficients without turning off the active noise cancellation is unable to guarantee the integrity of the update, so that the filter coefficients before and after the update are mixed simultaneously, thus causing noise and affecting user's auditory feeling.

Taking the biquad filter shown in FIG. 2 as an example, five noise cancellation coefficients (b1, b2, b3, a1, a2) included in the filter are a whole, which need to be synchronously updated in a certain noise cancellation processing cycle to prevent occurrence of an undetermined intermediate operation state. However, it is difficult to ensure that each of the filters in the active noise cancellation module completes overall update of all the noise cancellation coefficients within one noise cancellation processing cycle by taking a "storing" action, i.e., storing updated noise cancellation coefficients into the storage module through the software algorithm, as a timing for updating the noise cancellation coefficients in the active noise cancellation module. For example, the five noise cancellation coefficients used for the operation of the biquad filter in FIG. 2 are a whole. If the timing at which the software algorithm stores the updated noise cancellation coefficients does not match the timing at which the filter reads the noise cancellation coefficients, it may easily occur that b1, b2 and b3 are the noise cancellation coefficients before the update while a1 and a2 are the noise cancellation coefficients after the update in one noise cancellation processing cycle, i.e., two sets of new and old noise cancellation coefficients are used at the same time in one noise cancellation processing cycle, which causes an incorrect output result of the current noise cancellation processing cycle, thereby causing noise and poor auditory experience of the user. Therefore, a solution is urgently needed so that the noise cancellation coefficients of the active noise cancellation module are updated synchronously in one noise cancellation processing cycle without turning off the active noise cancellation module, and complexity of the system is not increased obviously.

An apparatus for audio signal processing is constructed by combining the active noise cancellation module and the software algorithm. The apparatus for audio signal processing includes a digital signal processor, the active noise cancellation module and at least two storage modules. The software algorithm may be instantiated as the digital signal processor configured to determine whether the noise cancellation coefficients of the active noise cancellation module need to be updated. If the noise cancellation coefficients of the active noise cancellation module need to be updated, new noise cancellation coefficients being generated are written into the storage module, and an update request is initiated to the active noise cancellation module. The active noise cancellation module reads the updated new noise cancellation coefficients from the storage module based on the update request, and selects an appropriate time to perform the noise cancellation processing using the updated noise cancellation coefficients, so as to ensure that all the noise cancellation coefficients are updated in one noise cancellation processing cycle.

Figure 3:
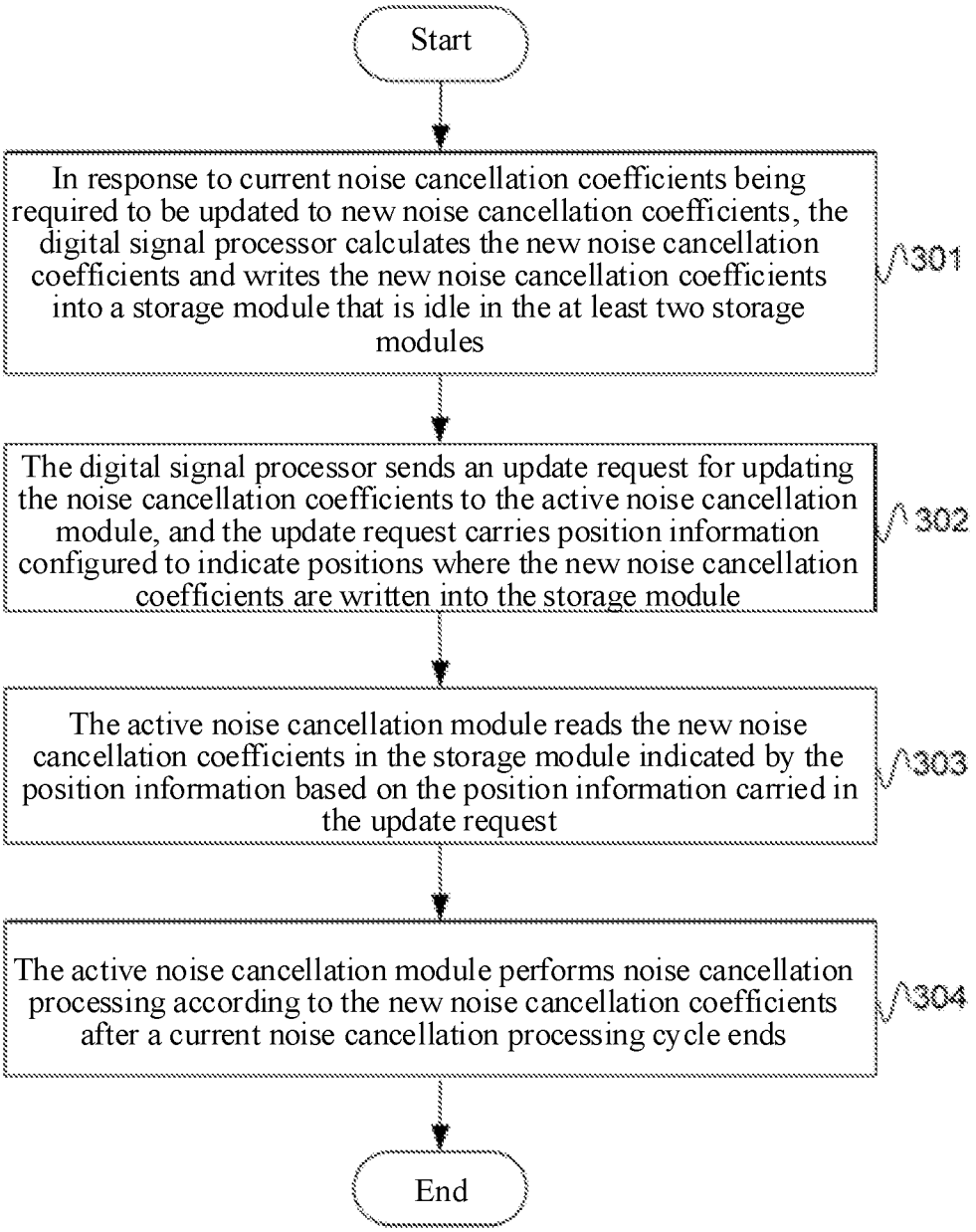
FIG. 3 is a flowchart of a method for audio noise cancellation in an embodiment of the present disclosure.

In an embodiment, the method for audio signal noise cancellation shown in FIG. 3, applied at the apparatus for audio signal processing described above, which includes the following steps.

In step 301, in response to current noise cancellation coefficients being required to be updated to new noise cancellation coefficients, the digital signal processor calculates the new noise cancellation coefficients and writes the new noise cancellation coefficients into a storage module that is idle in the at least two storage modules.

Figure 4:
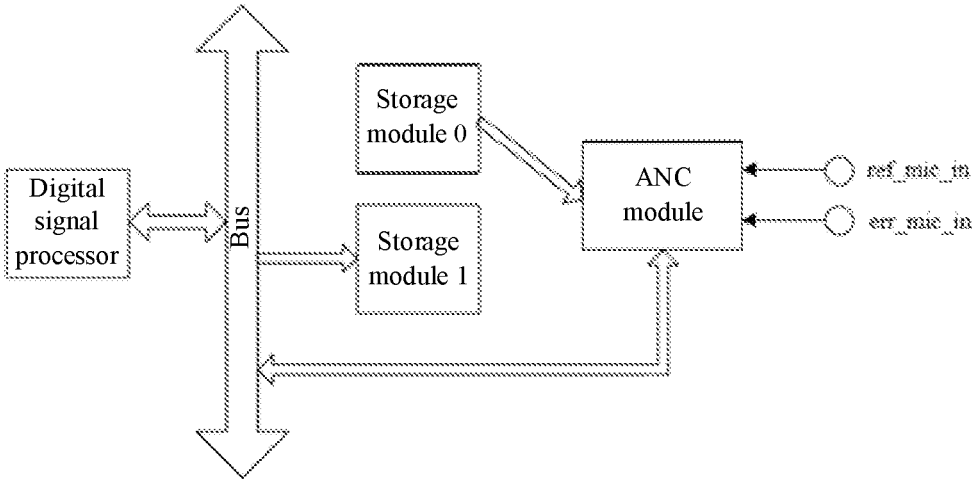
FIG. 4 is an architectural diagram of an apparatus for audio signal processing in an embodiment.

For example, in an architecture of the apparatus for audio signal processing shown in FIG. 4, on the one hand, the digital signal processor is responsible for running audio preprocessing algorithm, and sending decoded audio data (audio sampling data to be processed) to the ANC module through a bus for operation, so as to implement noise cancellation processing. On the other hand, in a process of performing the noise cancellation processing by the ANC module, the digital signal processor reads intermediate data calculated by the ANC module, monitors change of the ambient noise through the intermediate data in real time, and executes preset algorithm on changed data to determine whether to update the noise cancellation coefficients of the ANC module. That is, the digital signal processor automatically determines whether to update the current noise cancellation coefficients to the new noise cancellation coefficients according to the ambient noise of the apparatus for audio signal processing. When update of the noise cancellation coefficients is required, the digital signal processor first calculates new noise cancellation coefficients of the ANC module (called as "new noise cancellation coefficients"). The new noise cancellation coefficients have at least one coefficient different from a set of noise cancellation coefficients before the update.

In this embodiment, the audio preprocessing algorithm used by the digital signal processor to decode and generate the audio data, the preset algorithm used to determine whether to update the noise cancellation coefficients of the ANC module, and the algorithm used to calculate the new noise cancellation coefficients are not respectively limited, and those skilled in the art may use existing algorithms to complete the above calculation process.

The digital signal processor writes the calculated new noise cancellation coefficients to the idle storage module in the at least two storage modules through the bus. Here, the so-called "idle storage module" refers generally to a storage module currently in a "writable" state. When a granularity of a "read-write" operation for the storage module is a storage unit (one storage module may include a plurality of storage units), the storage module in the "writable" state may also refer to a storage unit in the "writable" state. For example, as shown in FIG. 4, a storage module 0 is in a "readable" state and a storage module 1 is in the "writable" state currently, the digital signal processor may write new noise cancellation coefficients into the storage module 1. Specifically, in this embodiment, the storage module in the "readable" state is a storage module or storage unit where the noise cancellation coefficients used in the current noise cancellation processing cycle are, and other storage modules or storage units except these storage modules or storage units may be considered to be in the "writable" state, i.e., the idle storage module.

Considering that the storage module has limited resources, when the updated noise cancellation coefficients are written into the storage module, positions in the storage module where the noise cancellation coefficients used in a historical noise cancellation processing cycle farthest from the current noise cancellation processing cycle are may be selected for overwriting, or only coefficients in the updated noise cancellation coefficients which are changed from the noise cancellation coefficients before the update may be written into the idle storage module. It should be understood that differences between the noise cancellation coefficients before and after the update may be large when ambient noise characteristics change greatly. In order to ensure that no noise generated in the coefficient update process, a plurality of sets of transition noise cancellation coefficients may be generated between the noise cancellation coefficients before and after the update by means of interpolation, and then the plurality of sets of transition coefficients and the new noise cancellation coefficients are written into the idle storage module stepwise to increase smoothness of the noise cancellation coefficient update.

In this scenario, the bus is configured to connect the digital signal processor, the storage modules, and the ANC module and be responsible for data communication between these modules. Devices on the bus follow the same protocols and standards and send and receive data according to certain priorities. Conventional bus protocols are advanced microcontroller bus architecture (AMBA) on-chip bus protocol and the like.

In addition, in this scenario, a plurality of storage modules may be provided, and each storage module may be configured to cache a set of noise cancellation coefficients used in one noise cancellation processing cycle. For example, as shown in FIG. 4, two sets of noise cancellation coefficients before and after the update may be in different storage modules. When an ANC module reads a certain storage module, the digital signal processor is unable to modify contents of the storage module and only able to write an updated set of noise cancellation coefficients into the idle storage module. When the writing of one set of noise cancellation coefficients is completed, objects of the two storage modules being read and written are changed. In this way, the integrity and synchronicity of each coefficient update are ensured. In consideration of power consumption and cost, a register group or a single port random access memory (RAM) may be selected to implement the storage module.

In step 302, the digital signal processor sends an update request for updating the noise cancellation coefficients to the active noise cancellation module, and the update request carries position information configured to indicate positions where the new noise cancellation coefficients are written into the storage module.

After the new noise cancellation coefficients are written into the storage module, the digital signal processor sends the update request to the ANC module. The update request carries the position information configured to indicate the positions where the new noise cancellation coefficients are written into the storage module. This embodiment does not limit the content and form of the position information and the manner of indicating the positions where the new noise cancellation coefficients are written into the storage module by the position information. For example, the position information may be a specific storage address of a new noise cancellation coefficient in each storage module, or may be an identification corresponding to the specific storage address, such as a storage module identification, a storage unit identification, and the like.

In step 303, the active noise cancellation module reads the new noise cancellation coefficients in the storage module indicated by the position information based on the position information carried in the update request.

For example, if the position information carried in the update request is a storage address in the storage module, the ANC module may directly read the updated noise cancellation coefficient from the storage address. If the position information carried in the update request is an identification corresponding to the storage address, such as a storage module identification, a storage unit identification, and the like, the ANC module may read the updated noise cancellation coefficient from the storage address in the storage module or in the storage unit corresponding to the identification.

In step 304, the active noise cancellation module performs noise cancellation processing according to the new noise cancellation coefficients after a current noise cancellation processing cycle ends.

The noise cancellation processing cycle of the active noise cancellation module with respect to one audio sampling data is a period in which the audio sampling data is input into the active noise cancellation module and the noise cancellation module performs all noise cancellation processing on the audio sampling data to finally output audio data after the noise cancellation. The active noise cancellation module starts active noise cancellation processing of a next audio sampling data after the active noise cancellation processing performed on the audio sampling data is completed and corresponding audio data after the noise cancellation is output. The ANC module is configured to receive an audio data stream sent by the digital signal processor, collect noise data such as ref mic_in and err mic_in data from an environment as audio sampling data, perform digital filtering processing on the audio sampling data, and output audio data on which the noise cancellation is performed to drive a next-stage circuit. During performing the noise cancellation processing, the ANC module continues to complete the noise cancellation processing of the current noise cancellation processing cycle based on the current noise cancellation coefficients after receiving the update request sent by the digital signal processor. When the current noise cancellation processing cycle ends and a next noise cancellation processing cycle starts, the ANC module acquires updated noise cancellation coefficients from the storage module indicated by the position information carried in the update request according to the position information, and continues the subsequent noise cancellation processing based on the updated noise cancellation coefficients. The ANC module completes overall update of all the noise cancellation coefficients in one noise cancellation processing cycle by selecting a time node at which the current noise cancellation processing cycle ends and the next noise cancellation processing period starts as a timing to update the noise cancellation coefficients.

As shown in the above example, in the method for audio signal noise cancellation provided in the present disclosure, in response to current noise cancellation coefficients being required to be updated to new noise cancellation coefficients without turning off the active noise cancellation module, the digital signal processor calculates the new noise cancellation coefficients and writes the new noise cancellation coefficients into an storage module that is idle in the at least two storage modules, and the digital signal processor sends an update request for updating the noise cancellation coefficients to the active noise cancellation module. The update request carries position information configured to indicate a position of the storage module to which the new noise cancellation coefficients is written. Then, the active noise cancellation module reads the new noise cancellation coefficients in the storage module indicated by the position information based on the position information carried in the update request, and performs noise cancellation processing according to the new noise cancellation coefficients after a current noise cancellation processing cycle ends. In the solution of the present disclosure, the active noise cancellation module does not immediately update the coefficients used in a process of the noise cancellation processing after receiving the update request, but selects the end of the current noise cancellation processing cycle as a timing for updating the old coefficients to new coefficients in the noise cancellation processing, so as to ensure that the noise cancellation processing may still be performed in the current noise cancellation processing cycle based on the noise cancellation coefficients before the update as a whole, and the noise cancellation processing may be performed in the subsequent noise cancellation processing cycle based on updated noise cancellation coefficients as a whole, thereby improving integrity of noise cancellation coefficient update, avoiding noise caused by the noise cancellation coefficient update, and improving user's auditory feeling.

In the following three embodiments, three specific implementations in which the digital signal processor writes the calculated new noise cancellation coefficients into an idle storage module in the at least two storage modules, the digital signal processor correspondingly generates the update request, and the active noise cancellation module reads the updated noise cancellation coefficients according to the update request are respectively provided.

Figure 5:
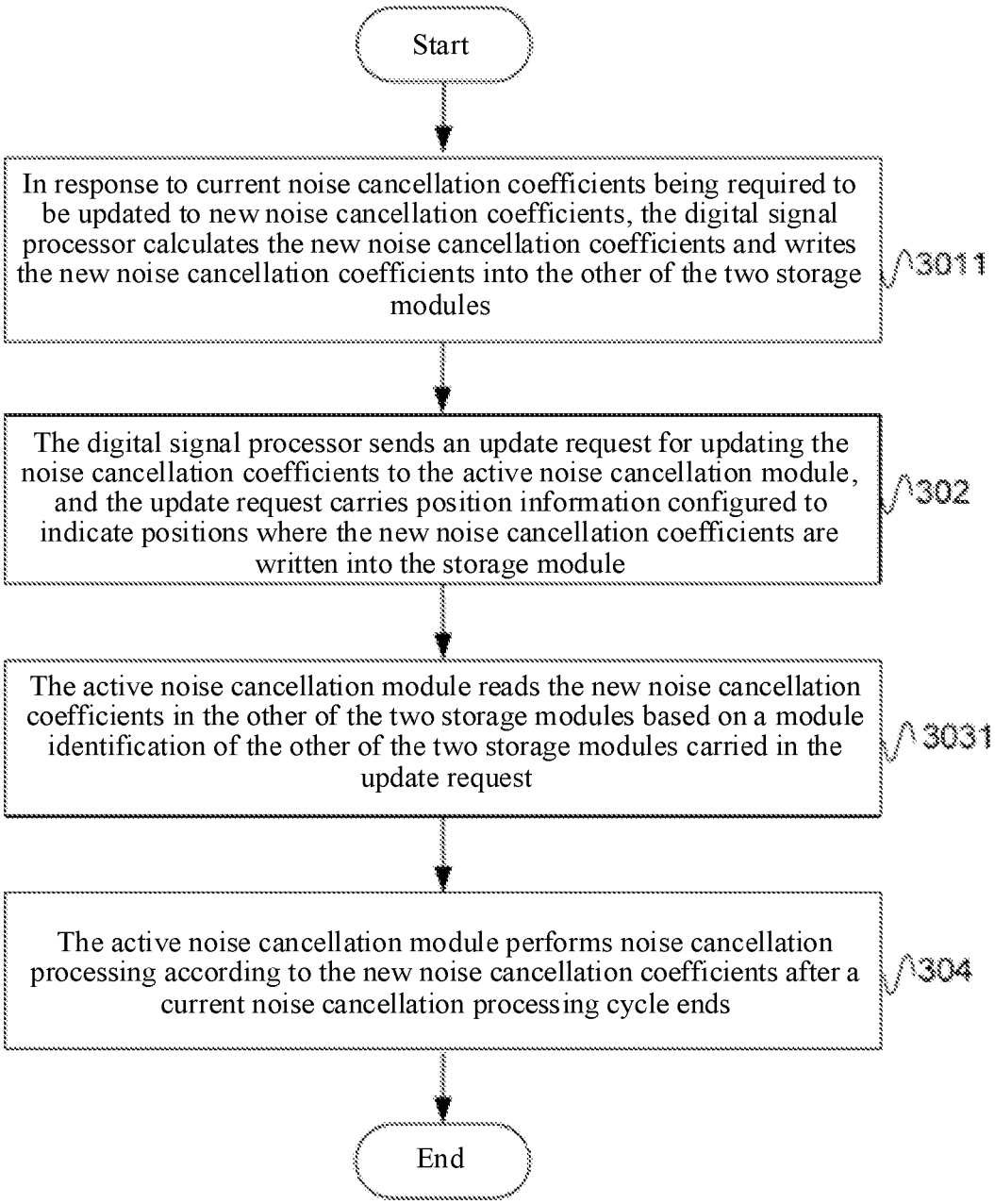
FIG. 5 is another flowchart of a method for audio noise cancellation in an embodiment.

In a method for audio signal noise cancellation shown in an embodiment, all the new noise cancellation coefficients are written into the idle storage module. As shown in FIG. 5, on the basis of the method embodiment shown in FIG. 3, the at least two storage modules include two storage modules. The current noise cancellation coefficients are written into one of the two storage modules. Accordingly, step 301 specifically includes the following sub-steps.

In sub-step 3011, in response to current noise cancellation coefficients being required to be updated to new noise cancellation coefficients, the digital signal processor calculates the new noise cancellation coefficients and writes the new noise cancellation coefficients into the other of the two storage modules.

The position information carried in the update request includes a module identification of the other of the two storage modules.

Specifically, the new noise cancellation coefficients calculated by the digital signal processor may be expressed as [a2, b2, c2, d2], and the noise cancellation coefficients before the update (i.e., noise cancellation coefficients used in the current noise cancellation processing cycle) may be expressed as [a1, b1, c1, d1], where a1 and a2, b1 and b2, c1 and c2, d1 and d2 are noise cancellation coefficients which respectively correspond to noise cancellation coefficients a, b, c, d before and after the update. All the noise cancellation coefficients before the update have been written into one of the two storage modules. The digital signal processor directly writes updated noise cancellation coefficients into the other of the two storage modules after generating the updated noise cancellation coefficient.

Figure 6A:
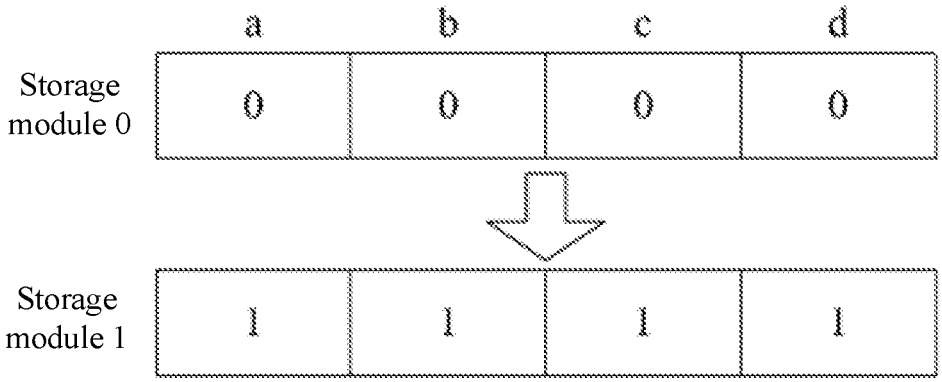
FIG. 6*a* is a distribution diagram of storage positions of noise cancellation coefficients in an embodiment.
Figure 6B:
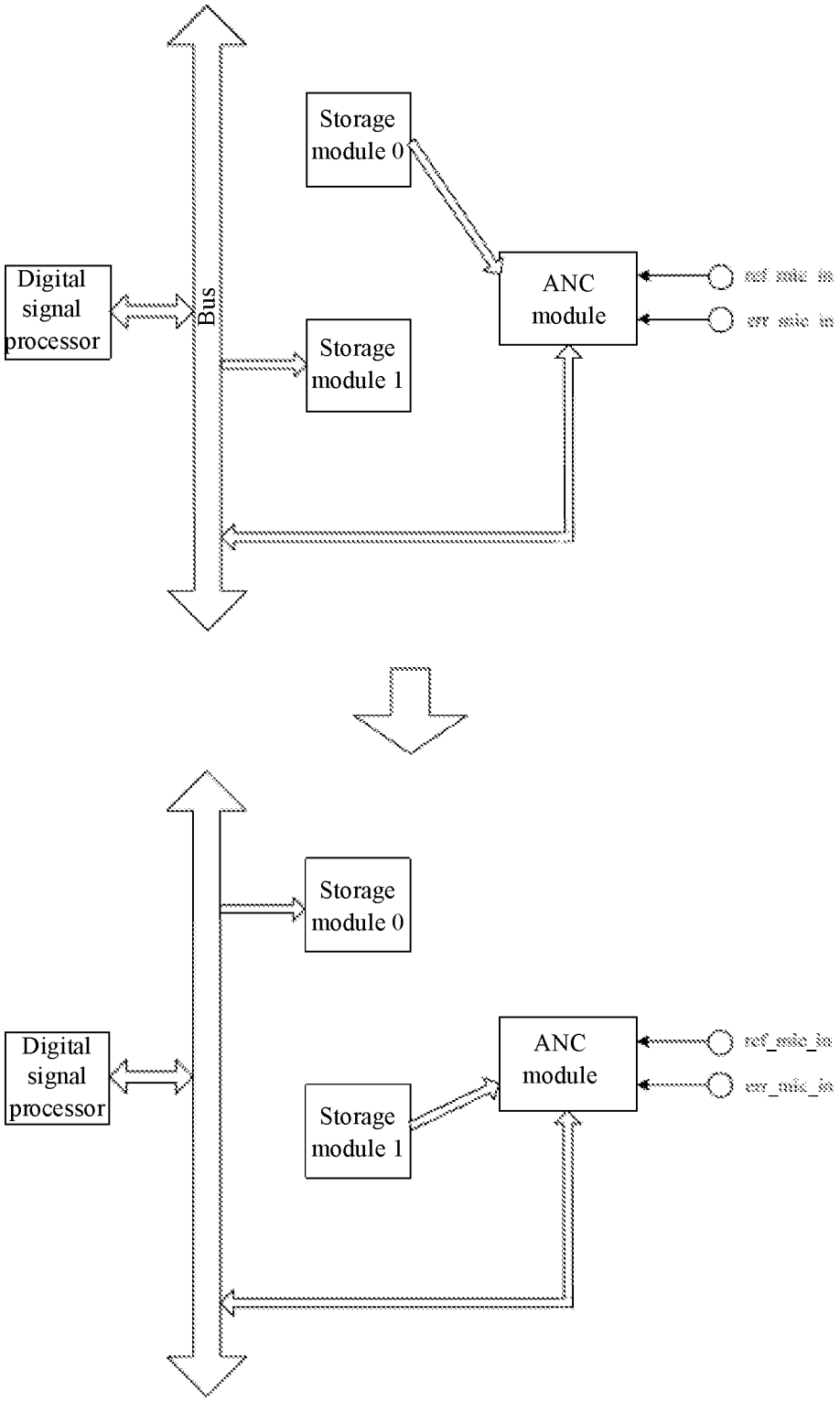
FIG. 6*b* is a scene graph of noise cancellation coefficient update of an ANC module in an embodiment.

For example, in combination with a distribution diagram of storage positions of the noise cancellation coefficients shown in FIG. 6*a* and a scene graph of noise cancellation coefficient update of the ANC module shown in FIG. 6*b*, an array of the noise cancellation coefficients is represented as [a, b, c, d]. During an update of the noise cancellation coefficients, the noise cancellation coefficients before the update are stored in a storage module 0 and represented as [0, 0, 0, 0]. Assuming that the updated noise cancellation coefficients are [1, 1, 1, 1], the digital signal processor may directly store the updated noise cancellation coefficients [1, 1, 1, 1] in a storage module 1. Then, the storage module 0 is set to the writable state and the storage module 1 is set to the readable state to, so that the ANC module is able to update noise cancellation coefficients used in the subsequent noise cancellation processing cycle.

Accordingly, on the basis of the sub-step 3011, as shown in FIG. 5, the step 303 may specifically include the following sub-steps.

In sub-step 3031, the active noise cancellation module reads the new noise cancellation coefficients in the other of the two storage modules based on a module identification of the other of the two storage modules carried in the update request.

In this example, all the updated noise cancellation coefficients are written into the other storage module different from the storage module where the current noise cancellation coefficients are, so that it is convenient to perform a write operation on all the updated noise cancellation coefficients quickly.

Figure 7:
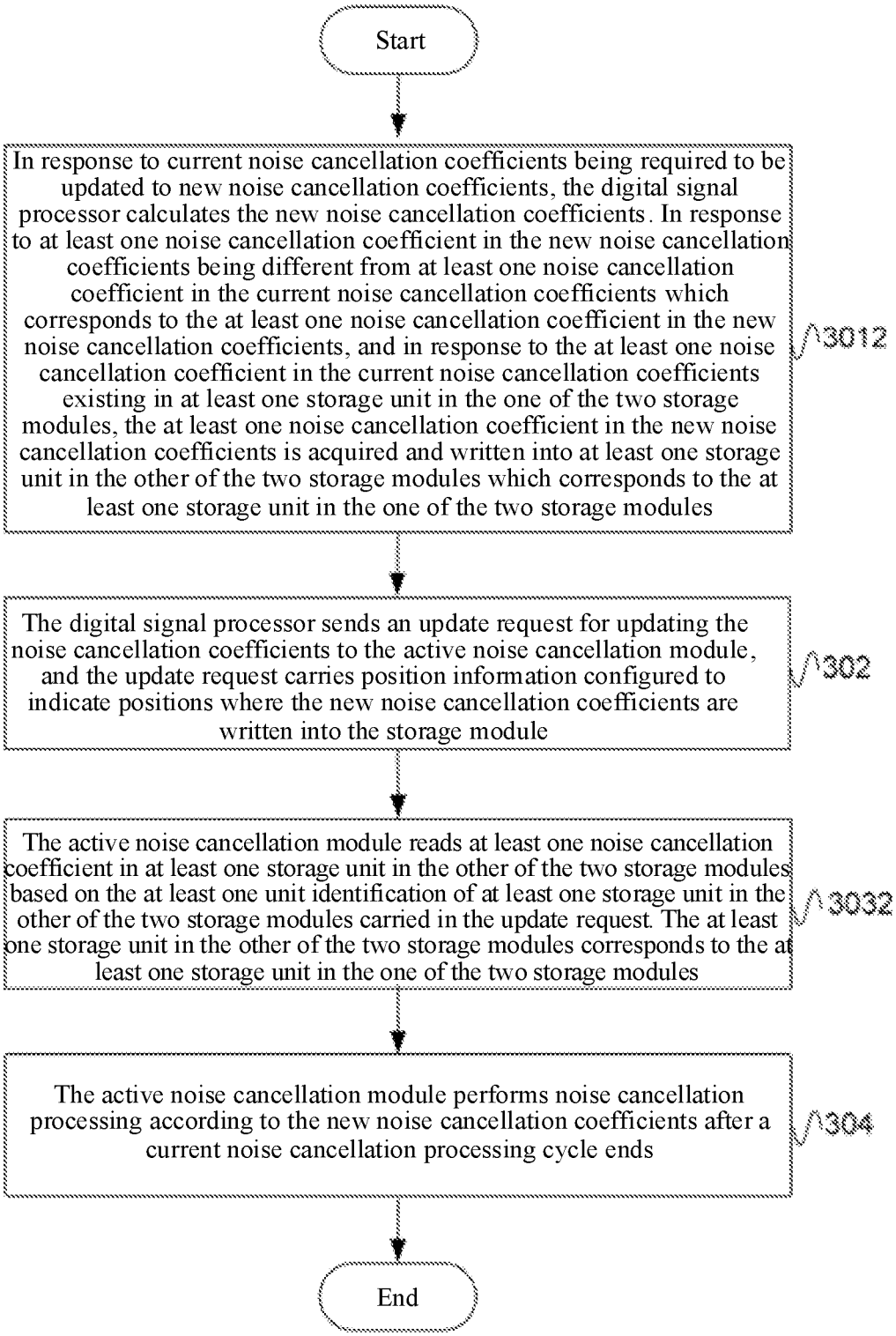
FIG. 7 is yet another flowchart of a method for audio noise cancellation in an embodiment.

In a method for audio signal noise cancellation shown in another embodiment, the new noise cancellation coefficients are partially written to an idle storage module. As shown in FIG. 7, on the basis of the method embodiment shown in FIG. 3, the at least two storage modules include two storage modules, each storage module is divided into at least two storage units, and the at least two storage units in one of the two storage modules are in one-to-one correspondences with the at least two storage units in the other of the two storage modules. The current noise cancellation coefficients are written into the one of the two storage modules. Accordingly, step 301 specifically includes the following sub-steps.

In sub-step 3012, in response to current noise cancellation coefficients being required to be updated to new noise cancellation coefficients, the digital signal processor calculates the new noise cancellation coefficients. In response to at least one noise cancellation coefficient in the new noise cancellation coefficients being different from at least one noise cancellation coefficient in the current noise cancellation coefficients which corresponds to the at least one noise cancellation coefficient in the new noise cancellation coefficients, and in response to the at least one noise cancellation coefficient in the current noise cancellation coefficients existing in at least one storage unit in the one of the two storage modules, the at least one noise cancellation coefficient in the new noise cancellation coefficients is acquired and written into at least one storage unit in the other of the two storage modules which corresponds to the at least one storage unit in the one of the two storage modules.

The position information carried in the update request includes at least one unit identification of the at least one storage unit in the other of the two storage modules which corresponds to the at least one storage unit in the one of the two storage modules.

Specifically, the new noise cancellation coefficients calculated by the digital signal processor may be expressed as [a2, b2, c2, d2], and the noise cancellation coefficients before the update (i.e., noise cancellation coefficients used in the current noise cancellation processing cycle) may be expressed as [a1, b1, c1, d1], where a1 and a2, b1 and b2, c1 and c2, d1 and d2 are noise cancellation coefficients which respectively correspond to noise cancellation coefficients a, b, c, d before and after the update. All the noise cancellation coefficients before the update have been written into one of the two storage modules, with a1 and b1 in the same storage unit, and c1 and d1 in the same storage unit. The digital signal processor compares each set of noise cancellation coefficients before and after the update after generating the updated noise cancellation coefficients. When it is determined that at least one noise cancellation coefficient in the noise cancellation coefficients before the update is different from that in the noise cancellation coefficients after the update, e.g., a1 is different from a2 and b1 is different from b2, the digital signal processor first acquires coefficients (a2 and b2) corresponding to the coefficients (i.e., a1 and b1) stored in a storage unit where the a1 and b1 are from the new noise cancellation coefficients, and then writes the corresponding coefficients (a2 and b2) into a storage unit in the other of the two storage modules (i.e., the storage module in which a1 and b1 do not exist) which corresponds to the storage unit where the a1 and b1 exist, thus reducing an amount of data of the noise cancellation coefficients actually written into the storage modules in the updated noise cancellation coefficients.

Figure 8A:
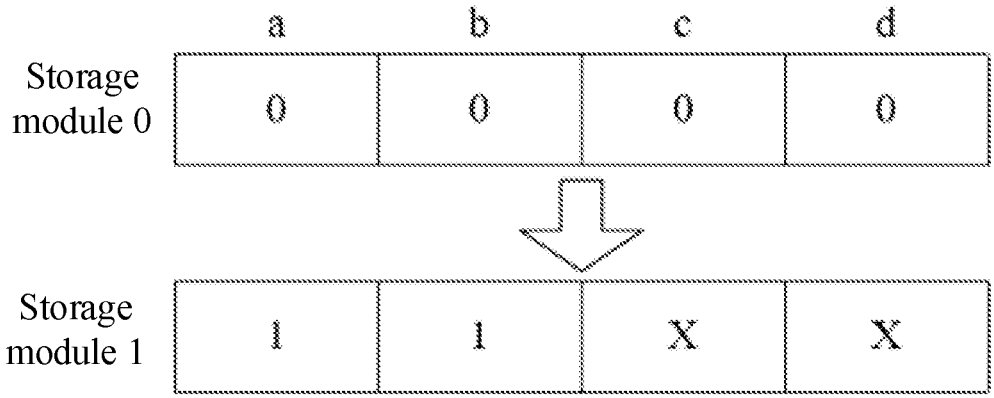
FIG. 8*a* is another distribution diagram of storage positions of noise cancellation coefficients in an embodiment.
Figure 8B:
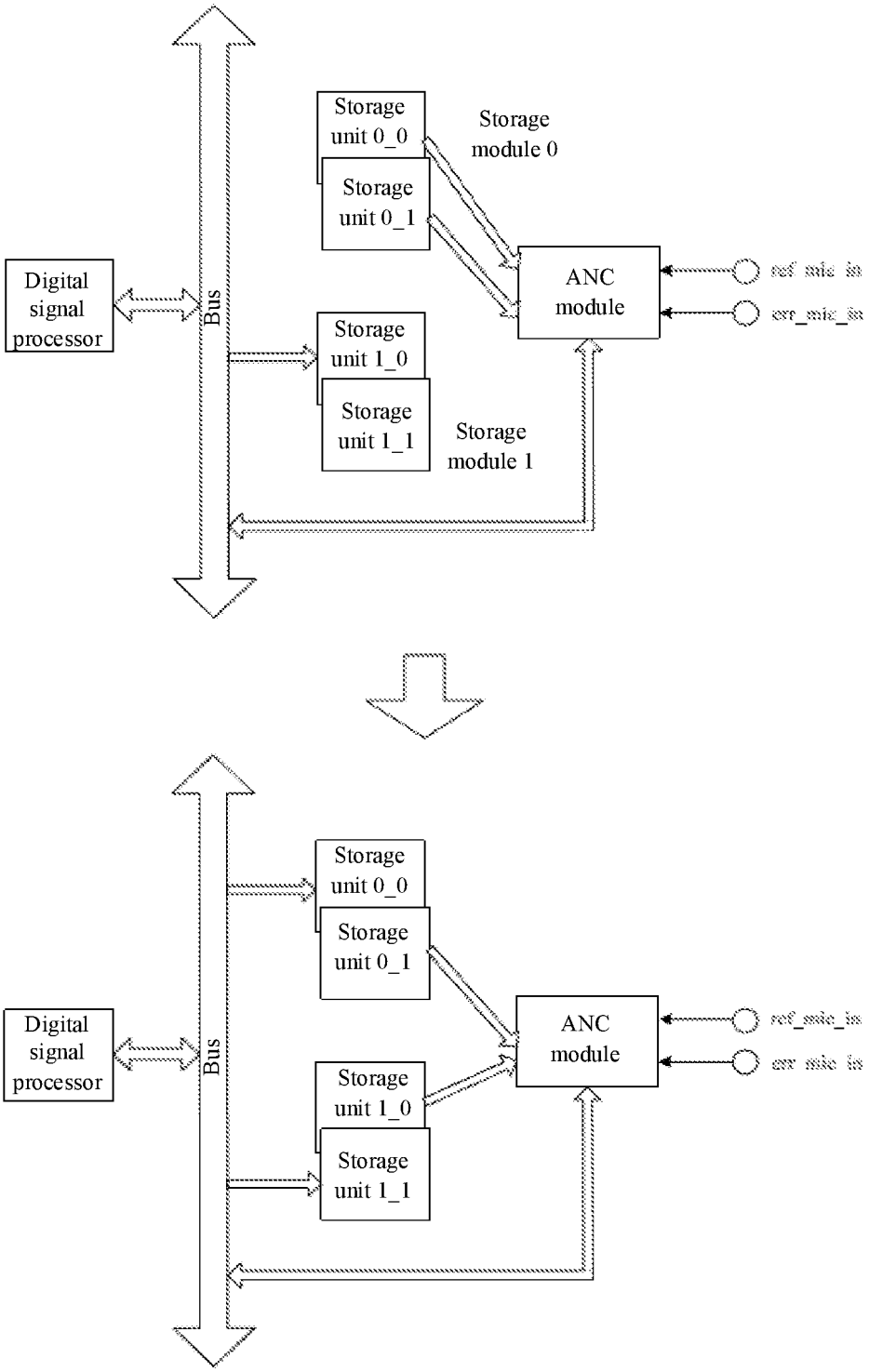
FIG. 8*b* is another scene graph of noise cancellation coefficient update of an ANC module in an embodiment.

For example, in combination with a distribution diagram of storage positions of noise cancellation coefficients shown in FIG. 8*a* and a scene graph of noise cancellation coefficient update of the ANC module shown in FIG. 8*b*, an array of the noise cancellation coefficients is represented as [a, b, c, d]. In the storage module 0 and the storage module 1, storage addresses for storing a and b are classified into one storage unit (i.e., a storage unit 0_0 and a storage unit 1_0), and the storage unit 0_0 corresponds to storage unit 1_0. Storage addresses for storing c and d are classified into one storage unit (i.e., a storage unit 0_1 and a storage unit 1_1), and the storage unit 0_1 corresponds to storage unit 1_1. During an update of the noise cancellation coefficients, the noise cancellation coefficients before the update are stored in the storage module 0 and represented as [0, 0, 0, 0]. Assuming that the updated noise cancellation coefficients are [1, 1, 0, 0], and that the two noise cancellation coefficients a and b in the updated noise cancellation coefficients are different from those in the noise cancellation coefficients before the update through comparison, the digital signal processor may store updated noise cancellation coefficients 1 and 1 corresponding to the a and b in the storage module 1 and the storage unit 1_0 configured to store the noise cancellation coefficients a and b. After the write operation is completed, the storage unit 0_0 configured to store the noise cancellation coefficients a and b in the storage module 0 is set to the writable state, and the storage unit 1_0 configured to store the noise cancellation coefficients a and b in the storage module 1 is set to the readable state. The updated new noise cancellation coefficients include noise cancellation coefficients c and d being 0 and 0 stored in the storage unit 0_1 in the storage module 0 and noise cancellation coefficients a and b being 1 and 1 stored in the storage unit 1_0 in the storage module 1.

Accordingly, on the basis of sub-step 3012, as shown in FIG. 7, step 303 may include the following sub-steps.

In sub-step 3032, the active noise cancellation module reads at least one noise cancellation coefficient in the at least one storage unit in the other of the two storage modules based on the at least one unit identification of the at least one storage unit in the other of the two storage modules carried in the update request. The at least one storage unit in the other of the two storage modules corresponds to the at least one storage unit in the one of the two storage modules.

In this embodiment, when the digital signal processor writes the updated noise cancellation coefficients into the idle storage module, the data amount of the written new noise cancellation coefficients may be reduced by selectively writing noise cancellation coefficients different from the current noise cancellation coefficients in the updated noise cancellation coefficients into the storage units in the idle storage module, thereby reducing the occupation of transmission resources (such as bus resources) and storage resources. Meanwhile, the ANC module may continue to read the noise cancellation coefficients that are not changed before and after the update from the original storage module based on the position information carried in the update request, and read the noise cancellation coefficients that are changed before and after the update from the other storage module.

Figure 9:
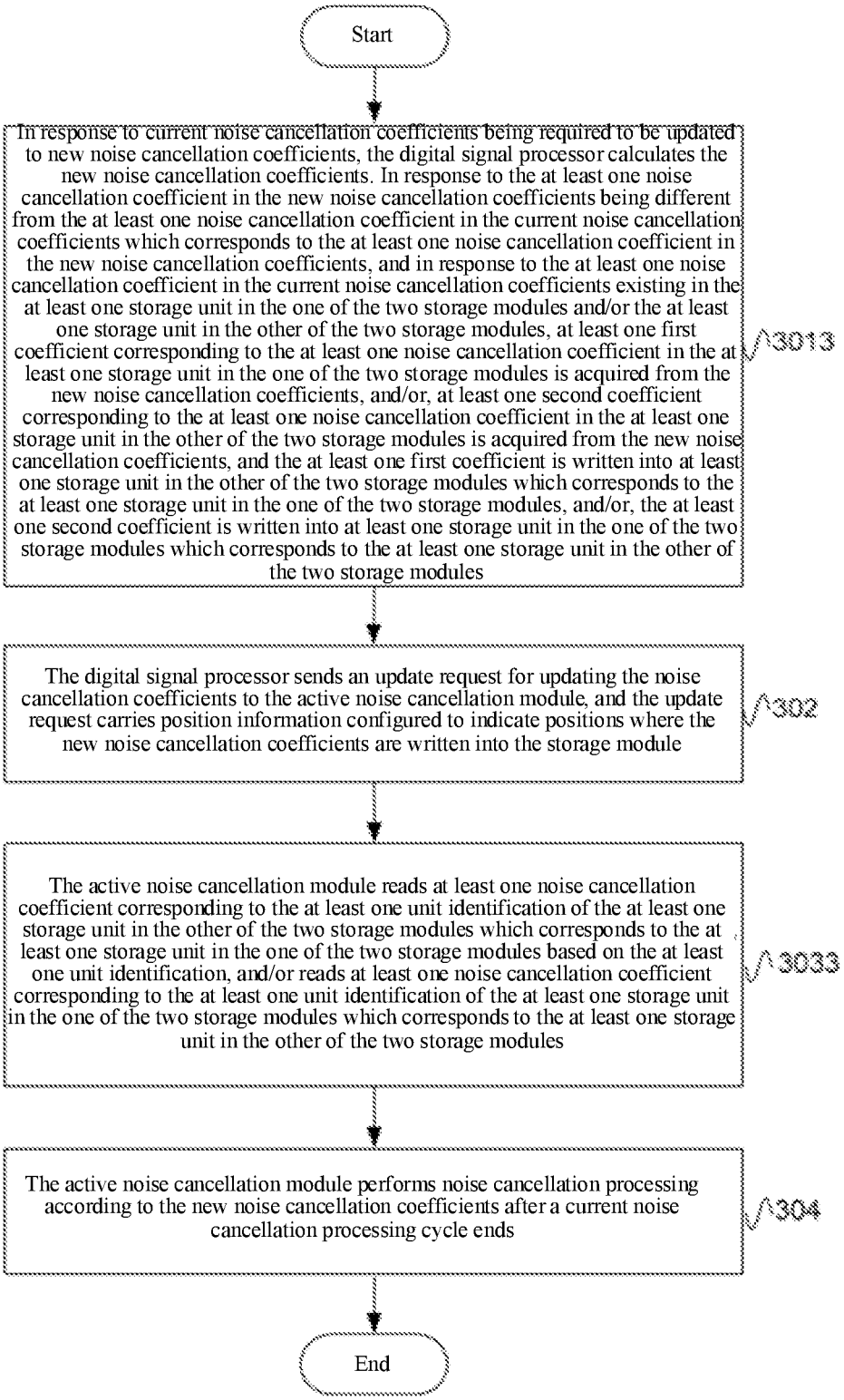
FIG. 9 is still another flowchart of a method for audio noise cancellation in an embodiment.

In a method for audio signal noise cancellation shown in another embodiment, all or some of the new noise cancellation coefficients are written into the idle storage module. As shown in FIG. 9, on the basis of the method embodiment shown in FIG. 7, the current noise cancellation coefficients are written into at least one storage unit in one of the two storage modules and at least one storage unit in the other of the two storage modules. The at least one storage unit in the other of the two storage modules corresponds to remaining storage units in the one of the two storage modules except the at least one storage unit in the one of the two storage modules. Correspondingly, step 301 specifically includes the following sub-steps.

In sub-step 3013, in response to current noise cancellation coefficients being required to be updated to new noise cancellation coefficients, the digital signal processor calculates the new noise cancellation coefficients. In response to the at least one noise cancellation coefficient in the new noise cancellation coefficients being different from the at least one noise cancellation coefficient in the current noise cancellation coefficients which corresponds to the at least one noise cancellation coefficient in the new noise cancellation coefficients, and in response to the at least one noise cancellation coefficient in the current noise cancellation coefficients existing in the at least one storage unit in the one of the two storage modules and/or the at least one storage unit in the other of the two storage modules, at least one first coefficient corresponding to the at least one noise cancellation coefficient in the at least one storage unit in the one of the two storage modules is acquired from the new noise cancellation coefficients, and/or, at least one second coefficient corresponding to the at least one noise cancellation coefficient in the at least one storage unit in the other of the two storage modules is acquired from the new noise cancellation coefficients, and the at least one first coefficient is written into at least one storage unit in the other of the two storage modules which corresponds to the at least one storage unit in the one of the two storage modules, and/or, the at least one second coefficient is written into at least one storage unit in the one of the two storage modules which corresponds to the at least one storage unit in the other of the two storage modules.

The position information carried in the update request includes one or both of at least one unit identification of the at least one storage unit in the other of the two storage modules which corresponds to the at least one storage unit in the one of the two storage modules and at least one unit identification of the at least one storage unit in the one of the two storage modules which corresponds to the at least one storage unit in the other of the two storage modules.

Specifically, the new noise cancellation coefficients calculated by the digital signal processor may be expressed as [a2, b2, c2, d2], and the noise cancellation coefficients before the update (i.e., noise cancellation coefficients used in the current noise cancellation processing cycle) may be expressed as [a1, b1, c1, d1], where a1 and a2, b1 and b2, c1 and c2, d1 and d2 are noise cancellation coefficients which respectively correspond to noise cancellation coefficients a, b, c, d before and after the update. All the noise cancellation coefficients before the update have been written into one of the two storage modules, with a1 and b1 in the same storage unit, c1 and d1 in the same storage unit, and these two storage units are respectively in different storage modules. The digital signal processor compares each set of noise cancellation coefficients before and after the update after generating the updated noise cancellation coefficients. When it is determined that at least one noise cancellation coefficient in the noise cancellation coefficients before the update is different from that in the noise cancellation coefficients after the update, e.g., a1 is different from a2 and b1 is different from b2, c1 is different from c2 and d1 is different from d2, or the four noise cancellation coefficients before the update are all different from the four noise cancellation coefficients after the update, the digital signal processor may continue to execute related processing steps with reference to step 3012, respectively acquire coefficients corresponding to the coefficients stored in each of storage units where updated and changed current noise cancellation coefficients exist from the new noise cancellation coefficients, write the coefficients corresponding to the coefficients stored in each of the storage units into storage units in the other storage module different from the storage module where each of the above storage units is. Each of the storage units in the other storage module corresponds to each of the above storage units.

Figure 10A:
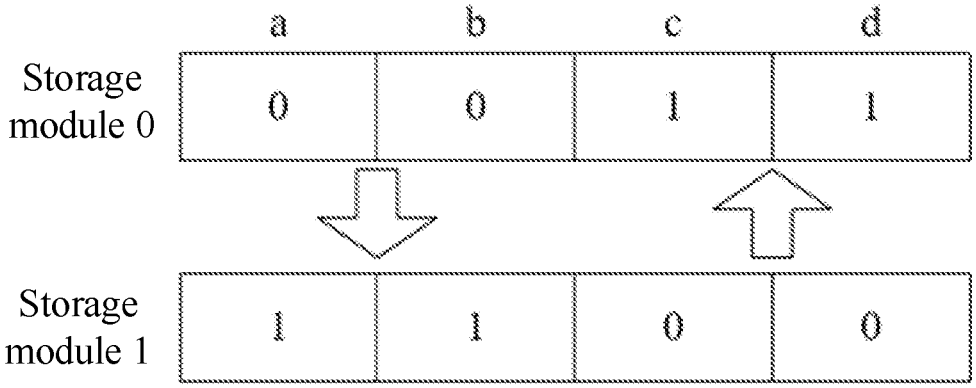
FIG. 10*a* is still another distribution diagram of storage positions of noise cancellation coefficients in an embodiment.
Figure 10B:
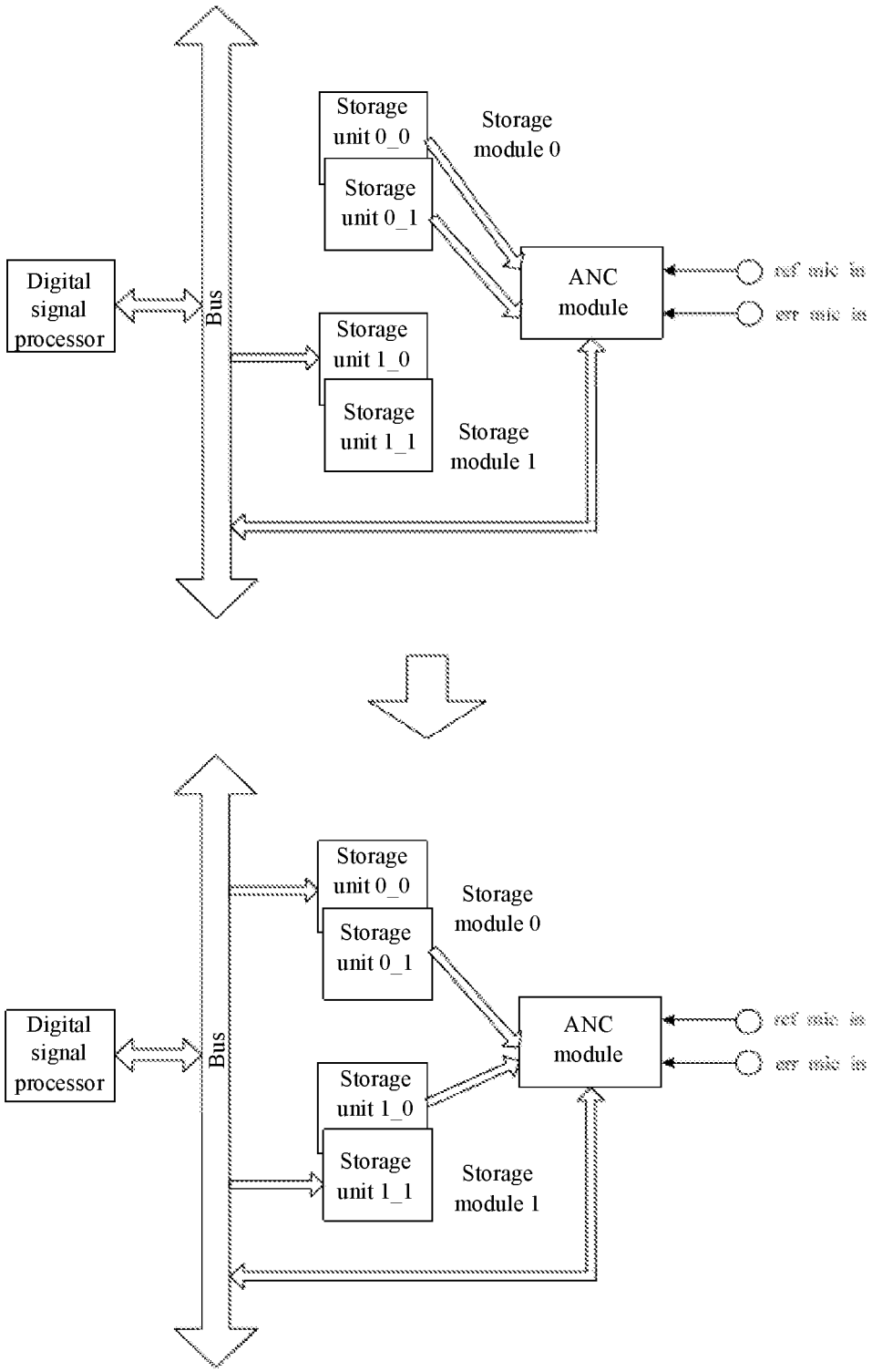
FIG. 10*b* is still another scene graph of noise cancellation coefficient update of an ANC module in an embodiment.

For example, with reference to a distribution diagram of storage positions of noise cancellation coefficients shown in FIG. 10*a* and a scene graph of noise cancellation coefficient update of the ANC module shown in FIG. 10*b*, an array of the noise cancellation coefficients is represented as [a, b, c, d]. In the storage module 0 and the storage module 1, storage addresses for storing a and b are classified into one storage unit (i.e., the storage unit 0_0 and the storage unit 1_0), and the storage unit 0_0 corresponds to storage unit 1_0. Storage addresses for storing c and d are classified into one storage unit (i.e., the storage unit 0_1 and the storage unit 1_1), and the storage unit 0_1 corresponds to storage unit 1_1. During an update of the noise cancellation coefficients, the noise cancellation coefficients before the update are stored in the storage unit 0_0 in the storage module 0 and the storage unit 1_1 in the storage module 1 and represented as [0, 0, 0, 0]. Assuming that the updated noise cancellation coefficients are [1, 1, 1, 1], and that the four noise cancellation coefficients a, b, c, and d in the updated noise cancellation coefficients are different from those in the noise cancellation coefficients before the update, the digital signal processor may store the updated noise cancellation coefficients 1 and 1 corresponding to the a and b in the storage module 1 and the storage unit 1_0 configured to store the noise cancellation coefficients a and b, and store updated noise cancellation coefficients 1 and 1 corresponding to the c and d in the storage module 0 and the storage unit 0_1 configured to store the noise cancellation coefficients c and d. After the write operation is completed, the storage unit 0_0 configured to store the noise cancellation coefficients a and b in the storage module 0 is set to the writable state, the storage unit 1_0 configured to store the noise cancellation coefficients a and b in the storage module 1 is set to the readable state, the storage unit 0_1 configured to store the noise cancellation coefficients c and d in the storage module 0 is set to the readable state, and the storage unit 1_1 configured to store the noise cancellation coefficients c and d in the storage module 1 is set to the writable state. The updated new noise cancellation coefficients include noise cancellation coefficients c and d being 1 and 1 stored in the storage unit 0_1 in the storage module 0 and noise cancellation coefficients a and b being 1 and 1 stored in the storage unit 1_0 in the storage module 1.

Accordingly, on the basis of sub-step 3013, as shown in FIG. 9, step 303 may include the following sub-steps.

In sub-step 3033, the active noise cancellation module reads at least one noise cancellation coefficient corresponding to the at least one unit identification of the at least one storage unit in the other of the two storage modules which corresponds to the at least one storage unit in the one of the two storage modules based on the at least one unit identification, and/or reads at least one noise cancellation coefficient corresponding to the at least one unit identification of the at least one storage unit in the one of the two storage modules which corresponds to the at least one storage unit in the other of the two storage modules.

In this embodiment, when the digital signal processor writes the updated noise cancellation coefficients into the idle storage module, the data amount of the written new noise cancellation coefficients may be reduced by selectively writing noise cancellation coefficients different from the current noise cancellation coefficients in the updated noise cancellation coefficients into the storage units in the idle storage module, thereby reducing the occupation of transmission resources (such as bus resources) and storage resources. Meanwhile, the ANC module may continue to read the noise cancellation coefficients that are not changed before and after the update from the original storage module based on the position information carried in the update request, and read the noise cancellation coefficients that are changed before and after the update from the other storage module.

In any of the above method embodiments, a plurality of transition coefficients may be generated to achieve a smooth update of the noise cancellation coefficients. As in performing any of the above method embodiments, the following steps are performed.

The digital signal processor generates a plurality of sets of transition coefficients based on the new noise cancellation coefficients and the current noise cancellation coefficients, and the plurality of sets of transition coefficients are coefficients between the new noise cancellation coefficients and the current noise cancellation coefficients. Herein, values of the plurality of sets of transition coefficients are between values of the new noise cancellation coefficients and values of the current noise cancellation coefficients, and the values of the plurality of sets of transition coefficients smoothly change from the values of the current noise cancellation coefficients to the values of the new noise cancellation coefficients.

Accordingly, in step 301, writing the new noise cancellation coefficients into the storage module that is idle in the at least two storage modules includes: writing the plurality of sets of transition coefficients and the new noise cancellation coefficients into the storage module that is idle stepwise.

Accordingly, in step 304, performing the noise cancellation processing according to the new noise cancellation coefficients includes: performing the noise cancellation processing stepwise according to the plurality of sets of transition coefficients until noise cancellation coefficients of the active noise cancellation module are updated to the new noise cancellation coefficients.

In this example, the plurality of sets of transition coefficients are generated between the new noise cancellation coefficients and the current noise cancellation coefficients to achieve the smooth change from the current noise cancellation coefficients to the new noise cancellation coefficients, thereby ensuring the smooth of the audio signal after the noise cancellation output by the active noise cancellation module during the current noise cancellation coefficients are updated to the new noise cancellation coefficients.

Figure 11:
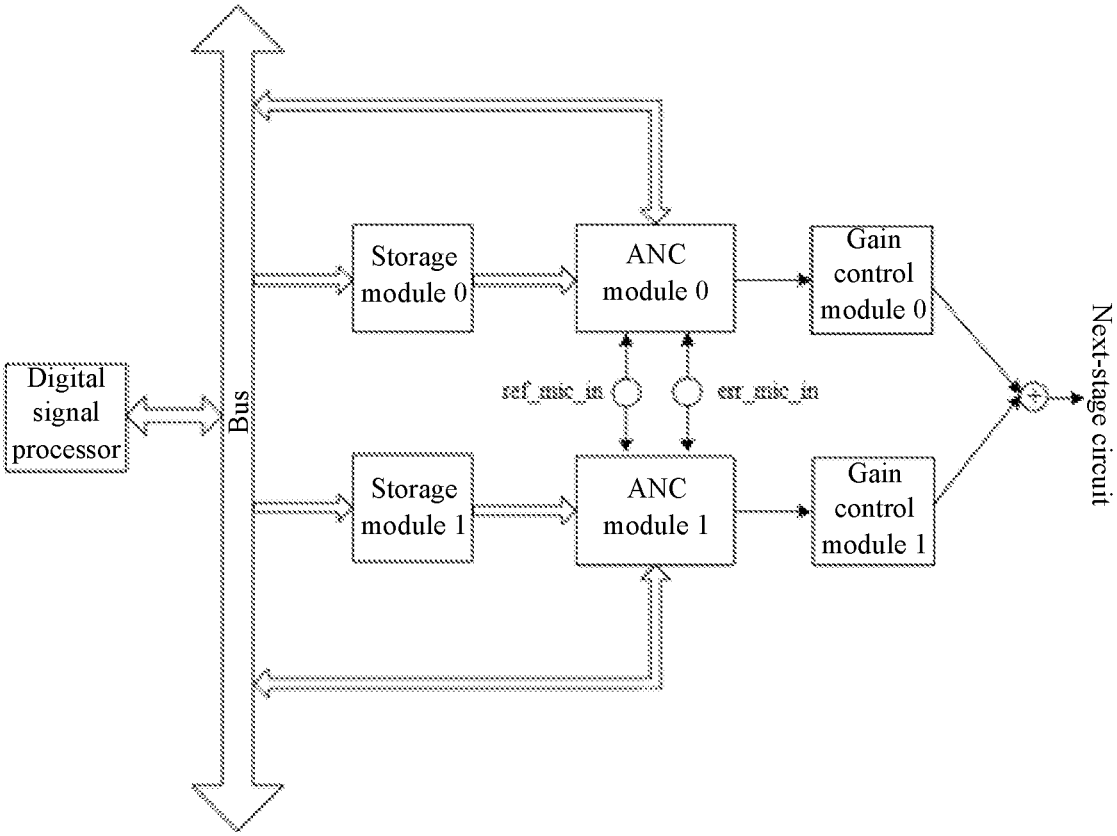
FIG. 11 is another architectural diagram of an apparatus for audio signal processing in an embodiment.

On the basis of the method embodiment shown in FIG. 5, as shown in FIG. 11, the active noise cancellation module may be two (i.e., an ANC module 0 and an ANC module 1), one active noise cancellation module (i.e., the ANC module 0) reads noise cancellation coefficients in one of the two storage modules (i.e., the storage module 0), and the other active noise cancellation module (i.e., the ANC module 1) reads noise cancellation coefficients in the other of the two storage modules (i.e., the storage module 1). Outputs of the two active noise cancellation modules are respectively connected to two gain control modules (i.e., a gain control module 0 and a gain control module 1). The gain control module is configured to control a gain of an output signal of the active noise cancellation module connected to the gain control module.

Figure 12:
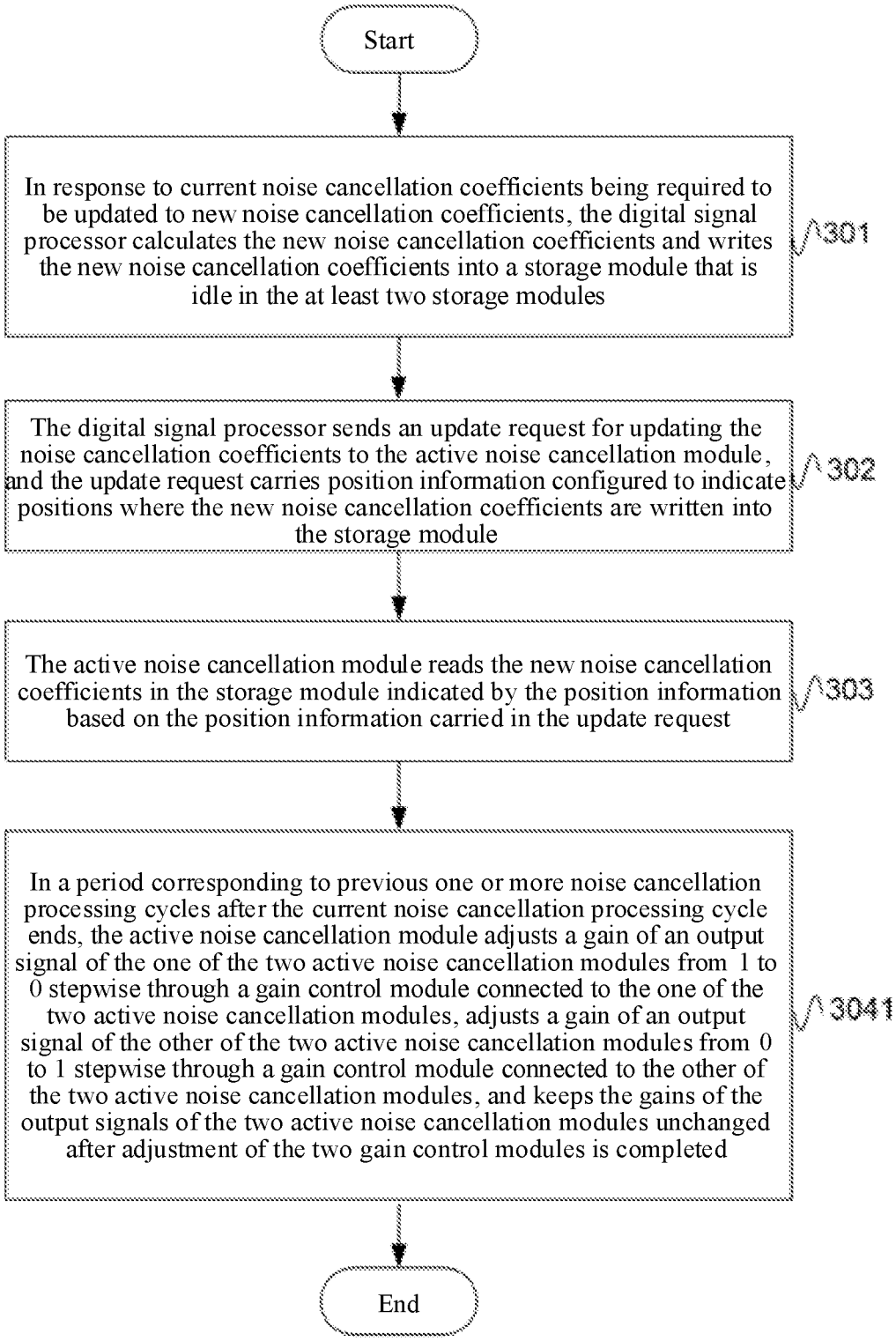
FIG. 12 is still yet another flowchart of a method for audio noise cancellation in an embodiment.

Accordingly, the step 304 may include the following sub-steps as shown in the method for audio signal noise cancellation in FIG. 12.

In sub-step 3041, in a period corresponding to previous one or more noise cancellation processing cycles after the current noise cancellation processing cycle ends, the active noise cancellation module adjusts a gain of an output signal of the one of the two active noise cancellation modules from 1 to 0 stepwise through a gain control module connected to the one of the two active noise cancellation modules, adjusts a gain of an output signal of the other of the two active noise cancellation modules from 0 to 1 stepwise through a gain control module connected to the other of the two active noise cancellation modules, and keeps the gains of the output signals of the two active noise cancellation modules unchanged after adjustment of the two gain control modules is completed.

For example, in the apparatus for audio signal processing shown in FIG. 11, the storage module 0 stores the noise cancellation coefficients used in the current noise cancellation processing cycle, i.e., the noise cancellation coefficients before the update, and the storage module 1 stores the updated noise cancellation coefficients, i.e., the new noise cancellation coefficients. After respectively receiving the update request sent by the digital signal processor and the current noise cancellation processing cycle ends, the ANC module 0 and the ANC module 1 respectively trigger the gain control units respectively connected to the ANC module 0 and the ANC module 1 to control the gains of the output signals of the ANC module 0 and the ANC module 1.

Specifically, the gain control module 0 connected to the ANC module 0 controls the gain of the output signal of the ANC module 0 to be gradually changed from 1 to 0, so as to achieve the same effect as "slowly turning off the ANC module 0". At the same time, the gain control module 1 connected to the ANC module 1 controls the gain of the output signal of the ANC module 1 to gradually change from 0 to 1, so as to achieve the same effect as "slowly turning on the ANC module 1." The output signals of the two gain control modules are superimposed as audio signal data after the noise cancellation finally output by the ANC module, thereby realizing the update of the noise cancellation coefficients.

In this embodiment, by providing the two ANC modules to respectively read the noise cancellation coefficients from the two storage modules, and adjusting the gains of the output signals of the two ANC modules through the two gain control modules, the update of the noise cancellation coefficients is easily achieved, and it is easier to implement the noise cancellation in terms of process and control difficulty compared with that the same ANC module performs noise cancellation processing by reading the noise cancellation coefficients from different storage modules.

For clarity of description, the steps of the above methods may be combined into one step or some steps may be split into multiple sub-steps, which are within the protection scope of the present disclosure as long as they include the same logical relationship. Irrelevant modifications added or irrelevant designs introduced into the algorithm or process but not changing the core design of the algorithm and process are within the protection scope of the present disclosure.

Figure 13:
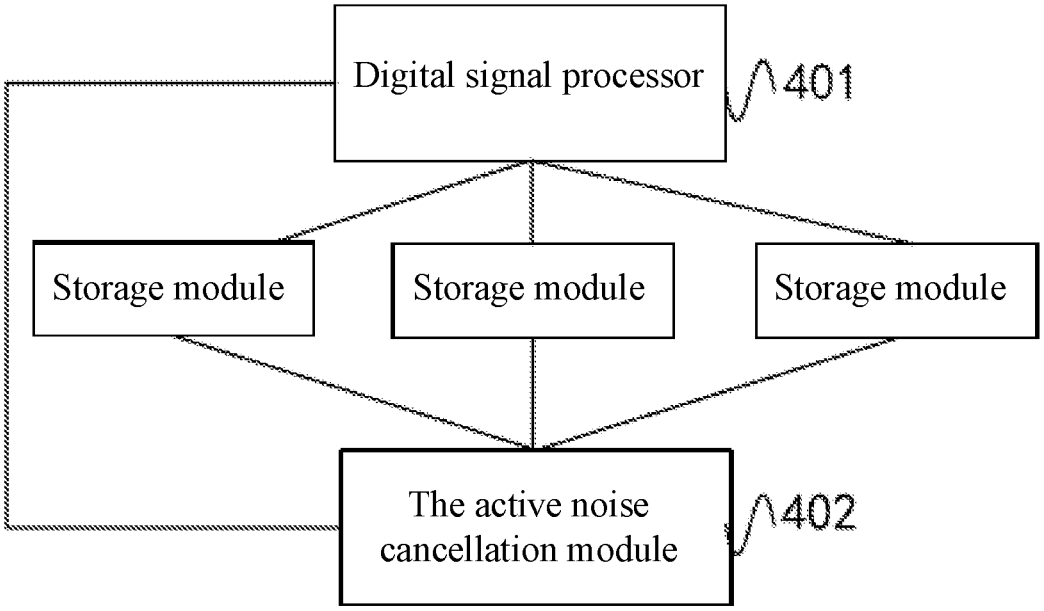
FIG. 13 is a schematic structural diagram of an apparatus for audio noise cancellation in an embodiment.

Some embodiments of the present disclosure further provide an apparatus audio signal processing, as shown in FIG. 13, the apparatus audio signal processing includes a digital signal processor 401, an active noise cancellation module 402 and at least two storage modules.

The digital signal processor 401 is configured to, in response to current noise cancellation coefficients being required to be updated to new noise cancellation coefficients, calculate the new noise cancellation coefficients, write the new noise cancellation coefficients into a storage module that is idle in the at least two storage modules, and send an update request for updating the noise cancellation coefficients to the active noise cancellation module. The update request carries position information configured to indicate positions where the new noise cancellation coefficients are written into the storage module.

The active noise cancellation module 402 is configured to read the new noise cancellation coefficients in the storage module indicated by the position information based on the position information carried in the update request, and perform noise cancellation processing according to the new noise cancellation coefficients after a current noise cancellation processing cycle ends.

In an example, the at least two storage modules include two storage modules, and the current noise cancellation coefficients are written into one of the two storage modules. The digital signal processor 401 is further configured to write the new noise cancellation coefficients into the other of the two storage modules. The position information carried in the update request includes a module identification of the other of the two storage modules.

The active noise cancellation module 402 is configured to read the new noise cancellation coefficients in the other of the two storage modules based on a module identification of the other of the two storage modules carried in the update request.

In an example, the at least two storage modules include two storage modules, each storage module is divided into at least two storage units, and the at least two storage units in one of the two storage modules are in one-to-one correspondences with the at least two storage units in the other of the two storage modules. The current noise cancellation coefficients are written into the one of the two storage modules. In response to at least one noise cancellation coefficient in the new noise cancellation coefficients being different from at least one noise cancellation coefficient in the current noise cancellation coefficients which corresponds to the at least one noise cancellation coefficient in the new noise cancellation coefficients, and in response to the at least one noise cancellation coefficient in the current noise cancellation coefficients existing in at least one storage unit in the one of the two storage modules, the at least one noise cancellation coefficient in the new noise cancellation coefficients is acquired and written into at least one storage unit in the other of the two storage modules which corresponds to the at least one storage unit in the one of the two storage modules.

The position information carried in the update request includes at least one unit identification of the at least one storage unit in the other of the two storage modules which corresponds to the at least one storage unit in the one of the two storage modules.

The active noise cancellation module 402 is configured to read at least one noise cancellation coefficient in the at least one storage unit in the other of the two storage modules based on the at least one unit identification of the at least one storage unit in the other of the two storage modules carried in the update request. The at least one storage unit in the other of the two storage modules corresponds to the at least one storage unit in the one of the two storage modules.

In an example, the current noise cancellation coefficients are written into at least one storage unit in one of the two storage modules and at least one storage unit in the other of the two storage modules. The at least one storage unit in the other of the two storage modules corresponds to remaining storage units in the one of the two storage modules except the at least one storage unit in the one of the two storage modules. The digital signal processor module 401 is configured to performed the following.

In response to current noise cancellation coefficients being required to be updated to new noise cancellation coefficients, the digital signal processor calculates the new noise cancellation coefficients. In response to the at least one noise cancellation coefficient in the new noise cancellation coefficients being different from the at least one noise cancellation coefficient in the current noise cancellation coefficients which corresponds to the at least one noise cancellation coefficient in the new noise cancellation coefficients, and in response to the at least one noise cancellation coefficient in the current noise cancellation coefficients existing in the at least one storage unit in the one of the two storage modules and/or the at least one storage unit in the other of the two storage modules, at least one first coefficient corresponding to the at least one noise cancellation coefficient in the at least one storage unit in the one of the two storage modules is acquired from the new noise cancellation coefficients, and/or, at least one second coefficient corresponding to the at least one noise cancellation coefficient in the at least one storage unit in the other of the two storage modules is acquired from the new noise cancellation coefficients, and the at least one first coefficient is written into at least one storage unit in the other of the two storage modules which corresponds to the at least one storage unit in the one of the two storage modules, and/or, the at least one second coefficient is written into at least one storage unit in the one of the two storage modules which corresponds to the at least one storage unit in the other of the two storage modules.

The position information carried in the update request includes one or both of at least one unit identification of the at least one storage unit in the other of the two storage modules which corresponds to the at least one storage unit in the one of the two storage modules and at least one unit identification of the at least one storage unit in the one of the two storage modules which corresponds to the at least one storage unit in the other of the two storage modules.

The active noise cancellation module 402 is configured to read at least one noise cancellation coefficient corresponding to the at least one unit identification of the at least one storage unit in the other of the two storage modules which corresponds to the at least one storage unit in the one of the two storage modules based on the at least one unit identification, and/or reads at least one noise cancellation coefficient corresponding to the at least one unit identification of the at least one storage unit in the one of the two storage modules which corresponds to the at least one storage unit in the other of the two storage modules.

In an example, the digital signal processor 401 is configured to generate a plurality of sets of transition coefficients based on the new noise cancellation coefficients and the current noise cancellation coefficients, and write the plurality of sets of transition coefficients and the new noise cancellation coefficients into the storage module that is idle stepwise. The plurality of sets of transition coefficients are coefficients between the new noise cancellation coefficients and the current noise cancellation coefficients.

The active noise cancellation module 402 is configured to perform the noise cancellation processing stepwise according to the plurality of sets of transition coefficients until noise cancellation coefficients of the active noise cancellation module 402 are updated to the new noise cancellation coefficients.

In an example, two active noise cancellation modules 402 are provided, one of the two active noise cancellation modules 402 reads noise cancellation coefficients in one of the two storage modules, and the other of the two active noise cancellation modules 402 reads noise cancellation coefficients in the other of the two storage modules. Output terminals of the two active noise cancellation modules 402 are respectively connected to two gain control modules which are configured to control gains of the output signals of the two active noise cancellation modules respectively connected to the two gain control modules.

In a period corresponding to previous one or more noise cancellation processing cycles after the current noise cancellation processing cycle ends, a gain of an output signal of the one of the two active noise cancellation modules 402 is adjusted from 1 to 0 stepwise through a gain control module connected to the one of the two active noise cancellation modules 402, a gain of an output signal of the other of the two active noise cancellation modules 402 is adjusted from 0 to 1 stepwise through a gain control module connected to the other of the two active noise cancellation modules, and the gains of the output signals of the two active noise cancellation modules 402 are kept unchanged after adjustment of the two gain control modules is completed.

In an example, the digital signal processor 401 is configured to automatically determine whether to update the current noise cancellation coefficients to the new noise cancellation coefficients according to the ambient noise of the apparatus for audio signal processing.

In this example, in response to current noise cancellation coefficients being required to be updated to new noise cancellation coefficients without turning off the active noise cancellation module, the digital signal processor calculates the new noise cancellation coefficients and writes the new noise cancellation coefficients into an storage module that is idle in the at least two storage modules, and the digital signal processor sends an update request for updating the noise cancellation coefficients to the active noise cancellation module. The update request carries position information configured to indicate a position of the storage module to which the new noise cancellation coefficients is written. Then, the active noise cancellation module reads the new noise cancellation coefficients in the storage module indicated by the position information based on the position information carried in the update request, and performs noise cancellation processing according to the new noise cancellation coefficients after a current noise cancellation processing cycle ends. In the solution of the present disclosure, the active noise cancellation module does not immediately update the coefficients used in a process of the noise cancellation processing after receiving the update request, but selects the end of the current noise cancellation processing cycle as a timing for updating the old coefficients to new coefficients in the noise cancellation processing, so as to ensure that the noise cancellation processing may still be performed in the current noise cancellation processing cycle based on the noise cancellation coefficients before the update as a whole, and the noise cancellation processing may be performed in the subsequent noise cancellation processing cycle based on updated noise cancellation coefficients as a whole, thereby improving integrity of noise cancellation coefficient update, avoiding noise caused by the noise cancellation coefficient update, and improving user's auditory feeling.

Some embodiments of the present disclosure further provide an electronic device, including: an apparatus for audio signal collection and the apparatus for audio signal processing according to any of the above embodiments. The apparatus for audio signal processing is configured to perform noise cancellation processing on audio signals collected by the apparatus for audio signal collection. For example, the electronic device may be a headphone.

Those skilled in the art should appreciate that the embodiments described above are specific embodiments for implementing the present disclosure. In practice, however, various changes may be made in the forms and details of the specific embodiments without departing from the spirit and scope of the present disclosure.

What is claimed is:

1. A method for audio signal noise cancellation, applied at an apparatus for audio signal processing, wherein the apparatus for audio signal processing comprises a digital signal processor, an active noise cancellation module and at least two storage modules, and the method comprises:

in response to current noise cancellation coefficients being required to be updated to new noise cancellation coefficients, the digital signal processor calculating the new noise cancellation coefficients and writing the new noise cancellation coefficients into a storage module that is idle in the at least two storage modules, and the digital signal processor sending an update request for updating the noise cancellation coefficients to the active noise cancellation module, wherein the update request carries position information configured to indicate positions where the new noise cancellation coefficients are written into the storage module; and the active noise cancellation module reading the new noise cancellation coefficients in the storage module indicated by the position information based on the position information carried in the update request, and performing noise cancellation processing according to the new noise cancellation coefficients after a current noise cancellation processing cycle ends.

2. The method according to claim 1, wherein the at least two storage modules include two storage modules, and the current noise cancellation coefficients are written into one of the two storage modules; wherein writing the new noise cancellation coefficients into the storage module that is idle in the at least two storage modules comprises:

writing the new noise cancellation coefficients into the other of the two storage modules; wherein the position information carried in the update request comprises a module identification of the other of the two storage modules; and wherein reading the new noise cancellation coefficients in the storage module indicated by the position information based on the position information carried in the update request comprises:

reading the new noise cancellation coefficients in the other of the two storage modules based on the module identification carried in the update request.

3. The method according to claim 1, wherein the at least two storage modules are two storage modules, each of the two storage modules is divided into at least two storage units, the at least two storage units in one of the two storage modules are in one-to-one correspondences with the at least two storage units in the other of the two storage modules, and the current noise cancellation coefficients are written into the one of the two storage modules; wherein writing the new noise cancellation coefficients into the storage module that is idle in the at least two storage modules comprises:

in response to at least one noise cancellation coefficient in the new noise cancellation coefficients being different from at least one noise cancellation coefficient in the current noise cancellation coefficients which corresponds to the at least one noise cancellation coefficient in the new noise cancellation coefficients, and in response to the at least one noise cancellation coefficient in the current noise cancellation coefficients existing in at least one storage unit in the one of the two storage modules, acquiring the at least one noise cancellation coefficient in the new noise cancellation coefficients, and writing the at least one noise cancellation coefficient in the new noise cancellation coefficients into at least one storage unit in the other of the two storage modules, wherein the at least one storage unit in the other of the two storage modules corresponds to the at least one storage unit in the one of the two storage modules;

wherein the position information carried in the update request comprises at least one unit identification of the at least one storage unit in the other of the two storage modules; and wherein reading the new noise cancellation coefficients in the storage module indicated by the position information based on the position information carried in the update request comprises:

reading at least one noise cancellation coefficient in the at least one storage unit in the other of the two storage modules based on the at least one unit identification carried in the update request.

4. The method according to claim 3, wherein the current noise cancellation coefficients are written into at least one storage unit in the one of the two storage modules and at least one storage unit in the other of the two storage modules, wherein the at least one storage unit in the other of the two storage modules corresponding to remaining storage units in the one of the two storage modules except the at least one storage unit in the one of the two storage modules; wherein writing the new noise cancellation coefficients into the storage module that is idle in the at least two storage modules comprises:

in response to the at least one noise cancellation coefficient in the new noise cancellation coefficients being different from the at least one noise cancellation coefficient in the current noise cancellation coefficients which corresponds to the at least one noise cancellation coefficient in the new noise cancellation coefficients, and in response to the at least one noise cancellation coefficient in the current noise cancellation coefficients existing in the at least one storage unit in the one of the two storage modules and/or the at least one storage unit in the other of the two storage modules, acquiring at least one first coefficient corresponding to the at least one noise cancellation coefficient in the at least one storage unit in the one of the two storage modules and/or at least one second coefficient corresponding to the at least one noise cancellation coefficient in the at least one storage unit in the other of the two storage modules from the new noise cancellation coefficients, and writing the at least one first coefficient into at least one storage unit in the other of the two storage modules which corresponds to the at least one storage unit in the one of the two storage modules, and/or, writing the at least one second coefficient into at least one storage unit in the one of the two storage modules which corresponds to the at least one storage unit in the other of the two storage modules;

wherein the position information carried in the update request comprises one or both of at least one unit identification of the at least one storage unit in the other of the two storage modules which corresponds to the at least one storage unit in the one of the two storage modules and at least one unit identification of the at least one storage unit in the one of the two storage modules which corresponds to the at least one storage unit in the other of the two storage modules; and wherein reading the new noise cancellation coefficients in the storage module indicated by the position information based on the position information carried in the update request comprises:

reading at least one noise cancellation coefficient corresponding to the at least one unit identification of the at least one storage unit in the other of the two storage modules which corresponds to the at least one storage unit in the one of the two storage modules based on the at least one unit identification, and/or reading at least one noise cancellation coefficient corresponding to the at least one unit identification of the at least one storage unit in the one of the two storage modules which corresponds to the at least one storage unit in the other of the two storage modules.

5. The method according to claim 1, further comprising:

the digital signal processor generating a plurality of sets of transition coefficients based on the new noise cancellation coefficients and the current noise cancellation coefficients, wherein the plurality of sets of transition coefficients are coefficients between the new noise cancellation coefficients and the current noise cancellation coefficients;

wherein writing the new noise cancellation coefficients into the storage module that is idle in the at least two storage modules comprises:

writing the plurality of sets of transition coefficients and the new noise cancellation coefficients into the storage module that is idle stepwise; and wherein performing the noise cancellation processing according to the new noise cancellation coefficients comprises:

performing the noise cancellation processing stepwise according to the plurality of sets of transition coefficients until noise cancellation coefficients of the active noise cancellation module are updated to the new noise cancellation coefficients.

6. The method according to claim 2, wherein two active noise cancellation modules are provided, one of the two active noise cancellation modules reads noise cancellation coefficients in one of the two storage modules, and the other of the two active noise cancellation modules reads noise cancellation coefficients in the other of the two storage modules; wherein output terminals of the two active noise cancellation modules are respectively connected to two gain control modules which are configured to control gains of the output signals of the two active noise cancellation modules respectively connected to the two gain control modules; and wherein performing the noise cancellation processing according to the new noise cancellation coefficients after the current noise cancellation processing cycle ends comprises:

in a period corresponding to previous one or more noise cancellation processing cycles after the current noise cancellation processing cycle ends, adjusting a gain of an output signal of the one of the two active noise cancellation modules from 1 to 0 stepwise through a gain control modules connected to the one of the two active noise cancellation modules, adjusting a gain of an output signal of the other of the two active noise cancellation modules from 0 to 1 stepwise through a gain control module connected to the other of the two active noise cancellation modules, and keeping the gains of the output signals of the two active noise cancellation modules unchanged after adjustment of the two gain control modules is completed.

7. The method according to claim 1, further comprising:

the digital signal processor automatically determining whether the current noise cancellation coefficients are required to be updated to the new noise cancellation coefficients according to ambient noise of the apparatus for audio signal processing.

8. An apparatus audio signal processing, comprising: a digital signal processor, an active noise cancellation module and at least two storage modules; wherein:

in response to current noise cancellation coefficients being required to be updated to new noise cancellation coefficients, the digital signal processor is configured to calculate the new noise cancellation coefficients, write the new noise cancellation coefficients into a storage module that is idle in the at least two storage modules, and send an update request for updating the noise cancellation coefficients to the active noise cancellation module, wherein the update request carries position information configured to indicate positions where the new noise cancellation coefficients are written into the storage module; and the active noise cancellation module is configured to read the new noise cancellation coefficients in the storage module indicated by the position information based on the position information carried in the update request, and perform noise cancellation processing according to the new noise cancellation coefficients after a current noise cancellation processing cycle ends.

9. The apparatus according to claim 8, wherein the at least two storage modules include two storage modules, and the current noise cancellation coefficients are written into one of the two storage modules; wherein the digital signal processor is further configured to:

write the new noise cancellation coefficients into the other of the two storage modules; wherein the position information carried in the update request comprises a module identification of the other of the two storage modules; and wherein the active noise cancellation module is further configured to:

read the new noise cancellation coefficients in the other of the two storage modules based on the module identification carried in the update request.

10. The apparatus according to claim 8, wherein the at least two storage modules are two storage modules, each of the two storage modules is divided into at least two storage units, the at least two storage units in one of the two storage modules are in one-to-one correspondences with the at least two storage units in the other of the two storage modules, and the current noise cancellation coefficients are written into the one of the two storage modules; wherein the digital signal processor is further configured to:

in response to at least one noise cancellation coefficient in the new noise cancellation coefficients being different from at least one noise cancellation coefficient in the current noise cancellation coefficients which corresponds to the at least one noise cancellation coefficient in the new noise cancellation coefficients, and in response to the at least one noise cancellation coefficient in the current noise cancellation coefficients existing in at least one storage unit in the one of the two storage modules, acquire the at least one noise cancellation coefficient in the new noise cancellation coefficients, and write the at least one noise cancellation coefficient in the new noise cancellation coefficients into at least one storage unit in the other of the two storage modules, wherein the at least one storage unit in the other of the two storage modules corresponds to the at least one storage unit in the one of the two storage modules;

wherein the position information carried in the update request comprises at least one unit identification of the at least one storage unit in the other of the two storage modules; and wherein the active noise cancellation module is further configured to:

reading at least one noise cancellation coefficient in the at least one storage unit in the other of the two storage modules based on the at least one unit identification carried in the update request.

11. The apparatus according to claim 10, wherein the current noise cancellation coefficients are written into at least one storage unit in the one of the two storage modules and at least one storage unit in the other of the two storage modules, wherein the at least one storage unit in the other of the two storage modules corresponding to remaining storage units in the one of the two storage modules except the at least one storage unit in the one of the two storage modules; wherein the digital signal processor is further configured to:

in response to the at least one noise cancellation coefficient in the new noise cancellation coefficients being different from the at least one noise cancellation coefficient in the current noise cancellation coefficients which corresponds to the at least one noise cancellation coefficient in the new noise cancellation coefficients, and in response to the at least one noise cancellation coefficient in the current noise cancellation coefficients existing in the at least one storage unit in the one of the two storage modules and/or the at least one storage unit in the other of the two storage modules, acquire at least one first coefficient corresponding to the at least one noise cancellation coefficient in the at least one storage unit in the one of the two storage modules and/or at least one second coefficient corresponding to the at least one noise cancellation coefficient in the at least one storage unit in the other of the two storage modules from the new noise cancellation coefficients, and write the at least one first coefficient into at least one storage unit in the other of the two storage modules which corresponds to the at least one storage unit in the one of the two storage modules, and/or, writing the at least one second coefficient into at least one storage unit in the one of the two storage modules which corresponds to the at least one storage unit in the other of the two storage modules;

wherein the position information carried in the update request comprises one or both of at least one unit identification of the at least one storage unit in the other of the two storage modules which corresponds to the at least one storage unit in the one of the two storage modules and at least one unit identification of the at least one storage unit in the one of the two storage modules which corresponds to the at least one storage unit in the other of the two storage modules; and wherein the active noise cancellation module is further configured to:

read at least one noise cancellation coefficient corresponding to the at least one unit identification of the at least one storage unit in the other of the two storage modules which corresponds to the at least one storage unit in the one of the two storage modules based on the at least one unit identification, and/or read at least one noise cancellation coefficient corresponding to the at least one unit identification of the at least one storage unit in the one of the two storage modules which corresponds to the at least one storage unit in the other of the two storage modules.

12. The apparatus according to claim 8, wherein the digital signal processor is further configured to generate a plurality of sets of transition coefficients based on the new noise cancellation coefficients and the current noise cancellation coefficients, and write the plurality of sets of transition coefficients and the new noise cancellation coefficients into the storage module that is idle stepwise, wherein the plurality of sets of transition coefficients are coefficients between the new noise cancellation coefficients and the current noise cancellation coefficients; and wherein the active noise cancellation module is further configured to:

perform the noise cancellation processing stepwise according to the plurality of sets of transition coefficients until noise cancellation coefficients of the active noise cancellation module are updated to the new noise cancellation coefficients.

13. The apparatus according to claim 11, wherein two active noise cancellation modules are provided, one of the two active noise cancellation modules reads noise cancellation coefficients in one of the two storage modules, and the other of the two active noise cancellation modules reads noise cancellation coefficients in the other of the two storage modules; wherein output terminals of the two active noise cancellation modules are respectively connected to two gain control modules which are configured to control gains of the output signals of the two active noise cancellation modules respectively connected to the two gain control modules; and wherein:

in a period corresponding to previous one or more noise cancellation processing cycles after the current noise cancellation processing cycle ends, a gain of an output signal of the one of the two active noise cancellation modules from 1 to 0 stepwise is adjusted through a gain control modules connected to the one of the two active noise cancellation modules, a gain of an output signal of the other of the two active noise cancellation modules from 0 to 1 stepwise is adjusted through a gain control module connected to the other of the two active noise cancellation modules, and the gains of the output signals of the two active noise cancellation modules are kept unchanged after adjustment of the two gain control modules is completed.

14. The apparatus according to claim 8, wherein the digital signal processor is further configured to automatically determine whether the current noise cancellation coefficients are required to be updated to the new noise cancellation coefficients according to ambient noise of the apparatus for audio signal processing.

15. An electronic device, comprising: an apparatus for audio signal collection and an apparatus for audio signal processing, wherein the apparatus for audio signal processing is configured to perform noise cancellation processing on audio signals collected by the apparatus for audio signal collection; wherein the apparatus for audio signal processing comprises: a digital signal processor, an active noise cancellation module and at least two storage modules; wherein:

in response to current noise cancellation coefficients being required to be updated to new noise cancellation coefficients, the digital signal processor is configured to calculate the new noise cancellation coefficients, write the new noise cancellation coefficients into a storage module that is idle in the at least two storage modules, and send an update request for updating the noise cancellation coefficients to the active noise cancellation module, wherein the update request carries position information configured to indicate positions where the new noise cancellation coefficients are written into the storage module; and the active noise cancellation module is configured to read the new noise cancellation coefficients in the storage module indicated by the position information based on the position information carried in the update request, and perform noise cancellation processing according to the new noise cancellation coefficients after a current noise cancellation processing cycle ends.

16. The electronic device according to claim 15, wherein the at least two storage modules include two storage modules, and the current noise cancellation coefficients are written into one of the two storage modules; wherein the digital signal processor is further configured to:

write the new noise cancellation coefficients into the other of the two storage modules; wherein the position information carried in the update request comprises a module identification of the other of the two storage modules; and wherein the active noise cancellation module is further configured to:

read the new noise cancellation coefficients in the other of the two storage modules based on the module identification carried in the update request.

17. The electronic device according to claim 15, wherein the at least two storage modules are two storage modules, each of the two storage modules is divided into at least two storage units, the at least two storage units in one of the two storage modules are in one-to-one correspondences with the at least two storage units in the other of the two storage modules, and the current noise cancellation coefficients are written into the one of the two storage modules; wherein the digital signal processor is further configured to:

in response to at least one noise cancellation coefficient in the new noise cancellation coefficients being different from at least one noise cancellation coefficient in the current noise cancellation coefficients which corresponds to the at least one noise cancellation coefficient in the new noise cancellation coefficients, and in response to the at least one noise cancellation coefficient in the current noise cancellation coefficients existing in at least one storage unit in the one of the two storage modules, acquire the at least one noise cancellation coefficient in the new noise cancellation coefficients, and write the at least one noise cancellation coefficient in the new noise cancellation coefficients into at least one storage unit in the other of the two storage modules, wherein the at least one storage unit in the other of the two storage modules corresponds to the at least one storage unit in the one of the two storage modules;

wherein the position information carried in the update request comprises at least one unit identification of the at least one storage unit in the other of the two storage modules; and wherein the active noise cancellation module is further configured to:

reading at least one noise cancellation coefficient in the at least one storage unit in the other of the two storage modules based on the at least one unit identification carried in the update request.

18. The electronic device according to claim 17, wherein the current noise cancellation coefficients are written into at least one storage unit in the one of the two storage modules and at least one storage unit in the other of the two storage modules, wherein the at least one storage unit in the other of the two storage modules corresponding to remaining storage units in the one of the two storage modules except the at least one storage unit in the one of the two storage modules; wherein the digital signal processor is further configured to:

in response to the at least one noise cancellation coefficient in the new noise cancellation coefficients being different from the at least one noise cancellation coefficient in the current noise cancellation coefficients which corresponds to the at least one noise cancellation coefficient in the new noise cancellation coefficients, and in response to the at least one noise cancellation coefficient in the current noise cancellation coefficients existing in the at least one storage unit in the one of the two storage modules and/or the at least one storage unit in the other of the two storage modules, acquire at least one first coefficient corresponding to the at least one noise cancellation coefficient in the at least one storage unit in the one of the two storage modules and/or at least one second coefficient corresponding to the at least one noise cancellation coefficient in the at least one storage unit in the other of the two storage modules from the new noise cancellation coefficients, and write the at least one first coefficient into at least one storage unit in the other of the two storage modules which corresponds to the at least one storage unit in the one of the two storage modules, and/or, writing the at least one second coefficient into at least one storage unit in the one of the two storage modules which corresponds to the at least one storage unit in the other of the two storage modules;

wherein the position information carried in the update request comprises one or both of at least one unit identification of the at least one storage unit in the other of the two storage modules which corresponds to the at least one storage unit in the one of the two storage modules and at least one unit identification of the at least one storage unit in the one of the two storage modules which corresponds to the at least one storage unit in the other of the two storage modules; and wherein the active noise cancellation module is further configured to:

read at least one noise cancellation coefficient corresponding to the at least one unit identification of the at least one storage unit in the other of the two storage modules which corresponds to the at least one storage unit in the one of the two storage modules based on the at least one unit identification, and/or read at least one noise cancellation coefficient corresponding to the at least one unit identification of the at least one storage unit in the one of the two storage modules which corresponds to the at least one storage unit in the other of the two storage modules.

19. The electronic device according to claim 15, wherein the digital signal processor is further configured to generate a plurality of sets of transition coefficients based on the new noise cancellation coefficients and the current noise cancellation coefficients, and write the plurality of sets of transition coefficients and the new noise cancellation coefficients into the storage module that is idle stepwise, wherein the plurality of sets of transition coefficients are coefficients between the new noise cancellation coefficients and the current noise cancellation coefficients; and wherein the active noise cancellation module is further configured to:

perform the noise cancellation processing stepwise according to the plurality of sets of transition coefficients until noise cancellation coefficients of the active noise cancellation module are updated to the new noise cancellation coefficients.

20. The electronic device according to claim 18, wherein two active noise cancellation modules are provided, one of the two active noise cancellation modules reads noise cancellation coefficients in one of the two storage modules, and the other of the two active noise cancellation modules reads noise cancellation coefficients in the other of the two storage modules; wherein output terminals of the two active noise cancellation modules are respectively connected to two gain control modules which are configured to control gains of the output signals of the two active noise cancellation modules respectively connected to the two gain control modules; and wherein:

in a period corresponding to previous one or more noise cancellation processing cycles after the current noise cancellation processing cycle ends, a gain of an output signal of the one of the two active noise cancellation modules from 1 to 0 stepwise is adjusted through a gain control modules connected to the one of the two active noise cancellation modules, a gain of an output signal of the other of the two active noise cancellation modules from 0 to 1 stepwise is adjusted through a gain control module connected to the other of the two active noise cancellation modules, and the gains of the output signals of the two active noise cancellation modules are kept unchanged after adjustment of the two gain control modules is completed.

* * * * *